United States Patent [19]

Peyton

[11] 4,257,727

[45] Mar. 24, 1981

[54] FULL DEPTH UNCASER

[75] Inventor: John J. Peyton, Santa Barbara, Calif.

[73] Assignee: Industrial Automation Corp., Goleta, Calif.

[21] Appl. No.: 945,393

[22] Filed: Sep. 25, 1978

Related U.S. Application Data

[60] Continuation-in-part of Ser. No. 772,425, Feb. 28, 1977, abandoned, which is a continuation of Ser. No. 572,440, Apr. 28, 1975, abandoned, which is a division of Ser. No. 408,922, Oct. 23, 1973, Pat. No. 3,938,847, which is a continuation-in-part of Ser. No. 305,709, Nov. 13, 1972, abandoned.

[51] Int. Cl.[3] ..... B65B 21/02

[52] U.S. Cl. ..... 414/416; 294/87.24

[58] Field of Search ..... 414/416; 198/459, 460, 198/461, 462, 491, 599, 600, 719, 725, 726, 732, 734, 694; 294/87 R, 87.22, 87.24, 100, 106, 110 R, 110 A, 115, 116

[56] References Cited

U.S. PATENT DOCUMENTS

| | | | |
|---|---|---|---|
| 1,855,767 | 4/1932 | Neuman | 198/503 X |
| 2,524,880 | 10/1950 | Cattonar et al. | 294/87.22 X |
| 2,533,230 | 12/1950 | Dixon | 294/110 R |
| 2,661,883 | 12/1953 | Francisco | 294/100 X |
| 2,666,562 | 1/1954 | Birch | 294/87 R X |
| 2,916,323 | 12/1969 | Berkum | 294/3 X |
| 2,986,262 | 5/1961 | Powers | 198/459 X |
| 3,041,102 | 6/1962 | Day | 294/19 R X |
| 3,125,369 | 3/1964 | Copping | 294/87.24 |
| 3,162,294 | 12/1964 | Dieter | 198/466 |
| 3,203,529 | 8/1965 | Mallory | 198/719 X |
| 3,311,224 | 3/1967 | King | 198/856 |
| 3,348,655 | 10/1967 | Pierce et al. | 198/461 |
| 3,382,965 | 5/1968 | Pierce et al. | 198/461 |
| 3,565,012 | 2/1971 | Nearman | 198/534 X |
| 3,627,106 | 12/1971 | Winfield | 198/478 |
| 3,652,117 | 3/1972 | Schroder | 294/87 R |

FOREIGN PATENT DOCUMENTS

| | | | |
|---|---|---|---|
| 692362 | 8/1964 | Canada | 198/459 |
| 1212127 | 3/1960 | France | 414/416 |

*Primary Examiner*—Stephen G. Kunin
*Assistant Examiner*—Terrance L. Siemens
*Attorney, Agent, or Firm*—Blakely, Sokoloff, Taylor & Zafman

[57] ABSTRACT

A full depth uncaser for automatically removing bottles from a case having a depth substantially equal to the bottle height, and delivering the bottles to a delivery conveyor. The uncaser utilizes a system of individual grippers arranged in the general pattern of the bottles in the cases, with the various rows of grippers supported by continuous chains at each side of a gripper assembly. Each individual gripper utilizes an over-center toggle mechanism held to the open position by the toggle, and triggerable by the contact of the center member with the top of a bottle to allow a spring to cause the gripper to close on the neck of the bottle. Bottles are released onto the delivery conveyor by depression of the center member at that point to reset the over-center mechanism. Provisions for synchronizing the cases with the gripper motion as well as other features, embodiments and improvements for such equipment are provided.

23 Claims, 34 Drawing Figures

104
106
108
7
272
270
100
96
98
6
250
99
54
120
252
254
102
94
92
256
260
90
22

Fig. 11
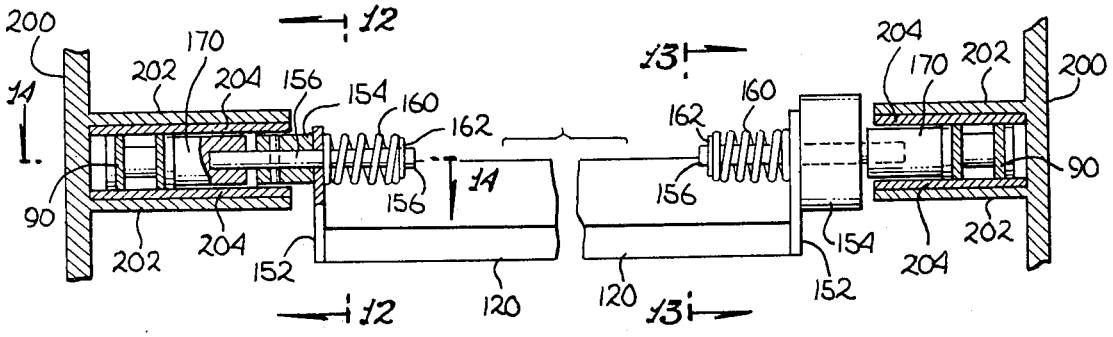
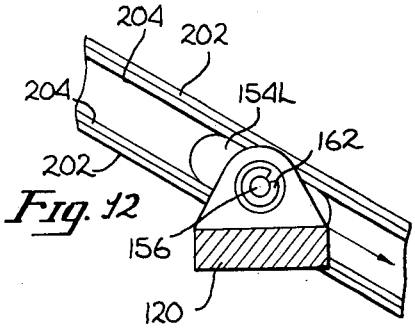
Fig. 12
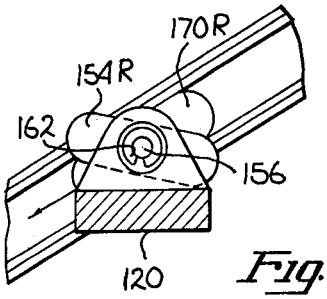
Fig. 13
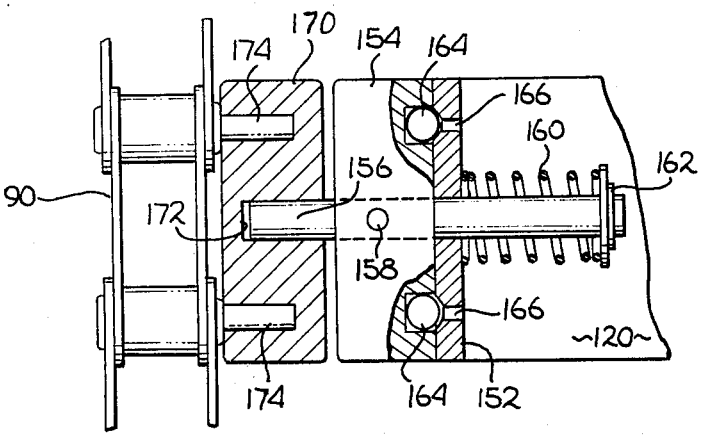
Fig. 14

Fig. 15
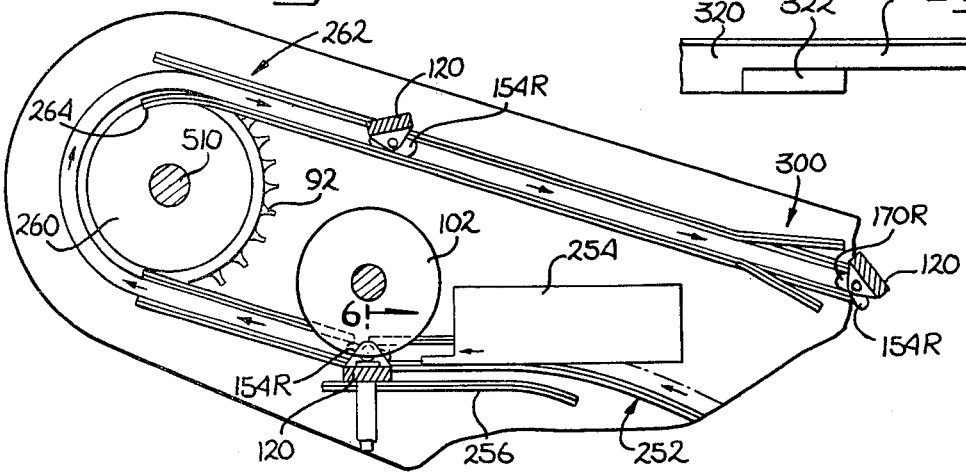
Fig. 18
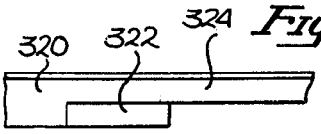
Fig. 16
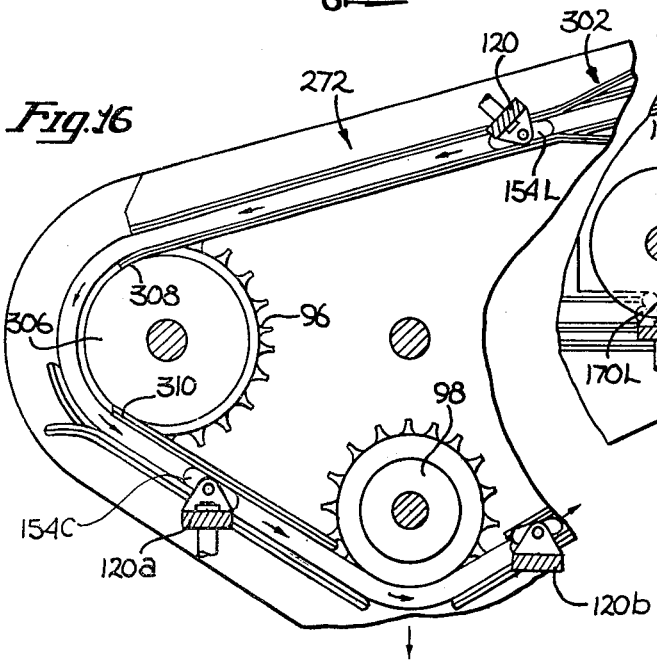
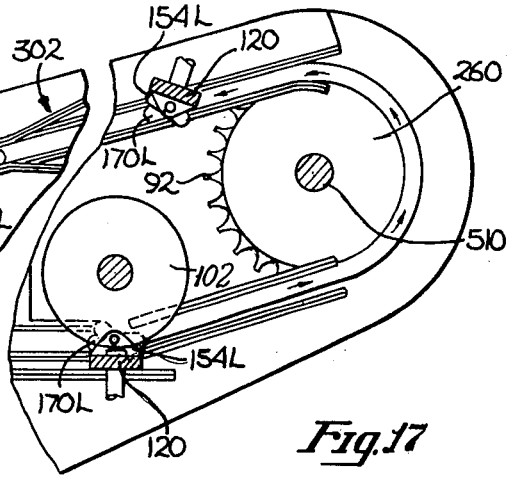
Fig. 17
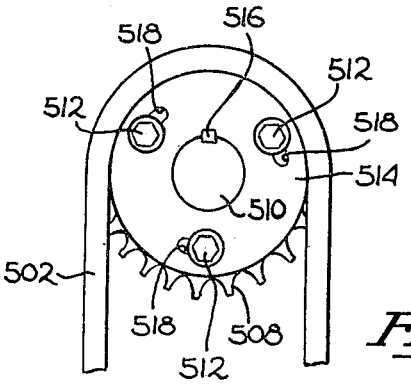
Fig. 19
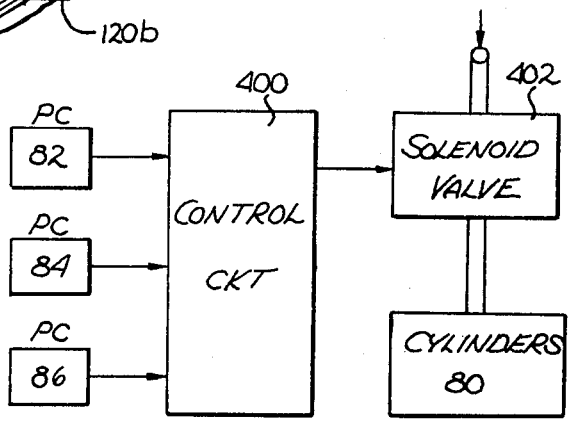
Fig. 20

FULL DEPTH UNCASERcl REFERENCE TO RELATED APPLICATIONS

This is a continuation-in-part of application Ser. No. 772,425 filed on Feb. 28, 1977 now abandoned which is a continuation of application Ser. No. 572,440 filed on Apr. 28, 1975 now abandoned, which is a division of application Ser. No. 408,922 filed on Oct. 23, 1973 (U.S. Pat. No. 3,938,847) which is a continuation-in-part of application Ser. No. 305,709 filed on Nov. 13, 1972 (abandoned).

BACKGROUND OF THE INVENTION

1. Field of the Invention

The present invention is related to the field of bottle handling apparatus, and more particularly to apparatus for removing bottles from a full depth case and delivering the bottles to a conveyor.

2. Brief Summary of the Invention

A full depth uncaser for automatically removing bottles from a case having a depth substantially equal to the bottle height, and delivering the bottles to a delivery conveyor. The Uncaser utilizes a first conveyor system for delivering cases full of bottles to a gripper system which grips the bottles, removes them from the cases and deposits the bottles on a delivery conveyor. The gripper system utilizes groups of individual grippers arranged in the general pattern of the bottles in the cases, with the various rows of grippers supported by continuous chains at each side of a gripper assembly. Each individual gripper utilizes an over-center toggle mechanism held to the open position by the toggle, and triggerable by the contact of a center member with the top of a bottle to allow a spring to cause the gripper to close on the neck of the bottle. Bottles are released onto the delivery conveyor by depression of the center member at that point. Gripping of individual bottles is rapidly achieved, with the horizontal component of velocity of the grippers being equal to the velocity of the case. Provisions for synchronizing the cases with the gripper motion as well as other features, embodiments and improvements for such equipment are disclosed.

BRIEF DESCRIPTION OF THE DRAWINGS

FIG. 11 is a typical cross-section of the transport means illustrating the manner of guiding the chains and cam members.

FIG. 12 is a cross-section taken along line 12—12 of FIG. 11.

FIG. 13 is a cross-section taken along line 13—13 of FIG. 11.

FIG. 14 is a cross-section taken along line 14—14 of FIG. 11.

FIG. 15 is a cross-section taken along line 15—15 of FIG. 1.

FIG. 16 is a cross-section taken along line 16—16 of FIG. 1.

FIG. 17 is a cross-section taken along line 17—17 of FIG. 1.

FIG. 18 is a top view of the guide track in the region 300 of FIG. 15.

FIG. 19 is a view of the sprocket 508 taken on an expanded scale.

FIG. 20 is a block diagram illustrating the case synchronizing control system.

DETAILED DESCRIPTION OF THE INVENTION

Figures 1, 2, 3, 4:
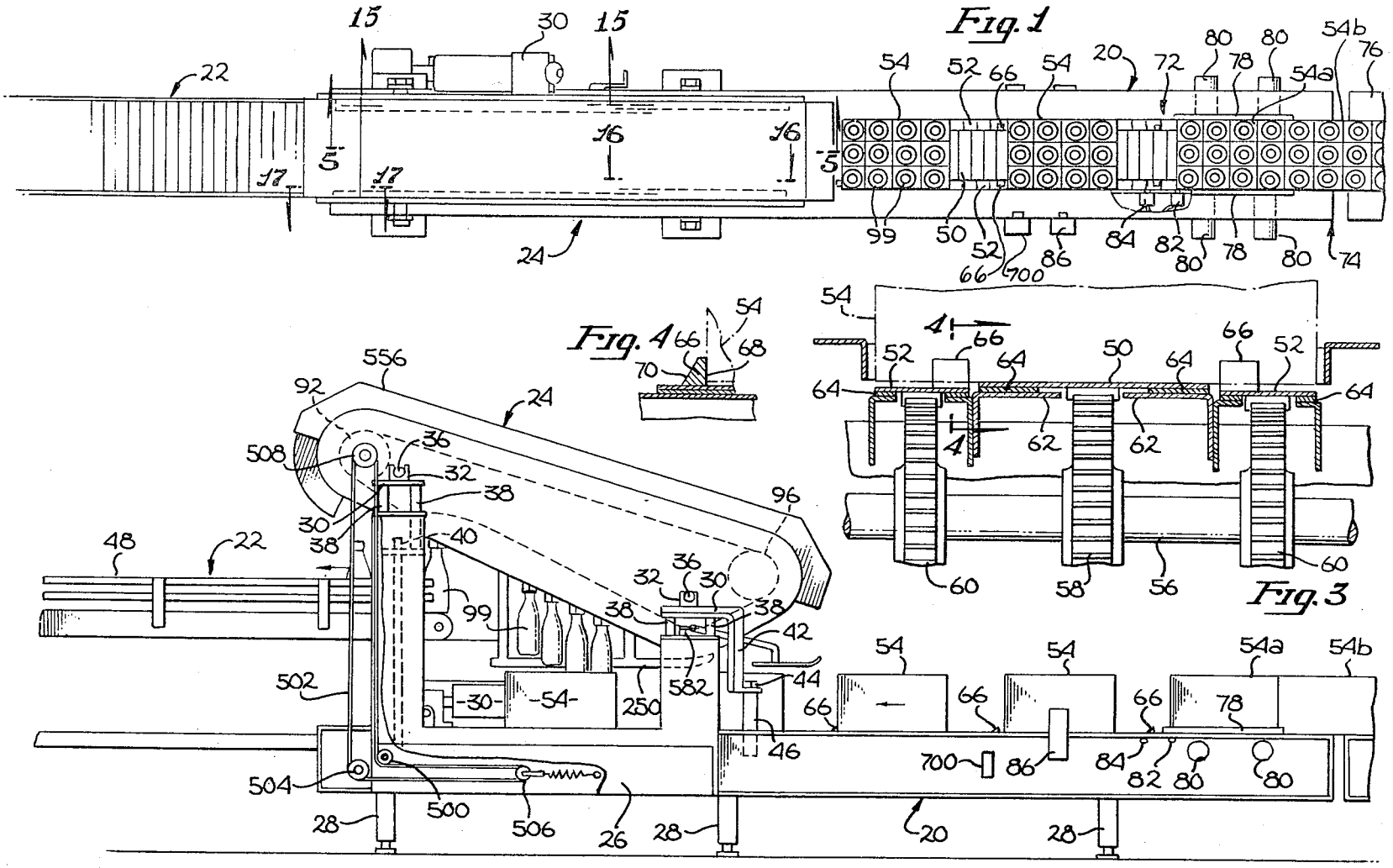
FIG. 1 is a top view of the uncaser of the present invention.
FIG. 2 is a side view of the uncaser.
FIG. 3 is a cross-section of the input conveyor illustrating the drive means therefor.
FIG. 4 is a cross-section taken along line 4—4 of FIG. 3.

First referring to FIGS. 1 and 2, a top view and a side view respectively of the present invention bottle uncaser may be seen. The uncaser is characterized by an input conveyor, generally indicated by the numeral 20, a delivery conveyor, generally indicated by the numeral 22, and an uncasing head generally indicated by the numeral 24 and located on and supported by a frame assembly 26. The frame assembly as well as the input conveyor, generally integral therewith, is supported on adjustable feet 28. On the frame assembly is a conventional drive motor means 30 and an elevation adjusting means for adjusting the relative elevation of the head 24 with respect to the input conveyor 20 and delivery conveyor 22. The elevation adjusting means adjusts the elevation of plates 30 and particularly yokes 32, in which the uncasing head 24 rests by means of pins 36. This elevation adjusting means is comprised of cylindrical members 38 slideably engaging the frame assembly and driven in vertical motion by lead screws, such as lead screw 40, to adjust the elevation of the uncasing head. The screws for all four support points are driven by a common chain drive system, so that both the forward and rear portion of the uncasing head are adjustable simultaneously in accordance with the size of the bottle being uncased. The elevation adjusting means is described in more detail in the patent entitled Case Unloading Machine, U.S. Pat. No. 3,570,693, heretofore referred to. The plates 30 on the forward lower adjustment means have an integral downward extension 42, with a support yoke 44 attached to the piston of a compressed air cylinder-piston assembly 46 supported on the downward extension 42. The purpose of this support yoke 44 is to provide a support and adjustment means for a half depth uncasing depth of the type disclosed in the hereinabove mentioned patent, with the air cylinder 46 providing one of the features covered in that patent. Thus, the basic frame assembly 26, together with the input conveyor 20 and the output conveyor 22, may be utilized with the uncasing head 24 of the present invention, or may be utilized to uncase half depth cases utilizing an uncasing head as described in the heretofore mentioned patent.

The delivery conveyor, generally indicated by the numeral 22, is a conveyor of generally conventional construction driven by the drive motor 30, and is provided with side fences 48 to prevent the accumulation of bottles on the conveyor from forcing the bottles off the side thereof. Thus the bottles are deposited on the conveyor to be delivered to a bottle washer or other apparatus as may be appropriate in the particular application.

The metal chain conveyors for the input conveyor are similar to that used for delivery conveyor. However, three conveyor chains are actually used. There is provided a relatively wide center conveyor chain 50, with narrower side chains 52 disposed on each side thereof. The chain 50 is at a slightly higher elevation than the chain 52, and in fact is driven at a slightly higher linear speed than the chains 52. Thus the cases rest on the center chain 50 and are driven or carried along thereby.

FIG. 3 presents a cross-section of the input conveyor 20 at the sprocket drive position for the chains 50 and 52. The sprocket drive is provided by conventional drive means driving shaft 56 in rotation. Shaft 56 drives a central sprocket 58 driving chain 50, and a pair of side sprockets 60 driving the side chains 52. It is to be noted that all three sprockets are driven at the same angular velocity. However, sprocket 58, being larger in diameter, has a higher surface speed, and therefore drives chain 50 with a higher linear velocity. Each of the chains 50 and 52 rests on support members such as members 62, with intermediate self lubricating plastic members 64 minimizing wear and frictional drag on the chains.

Adjacent the inner edge of the outer chains 52 are blocks 66, which may also be seen in the cross-section shown in FIG. 4 taken along lines 4—4 of FIG. 3. The blocks 66 have a substantially vertically disposed face 68 directed so as to engage cases resting on chain 50, when those cases catch up to a respective pair of blocks 66 as a result of the higher speed of the center chain supporting the case. Thus it may be seen that cases 54 resting on chain 50 between two pair of blocks 66 on the smaller chains will move at a higher linear velocity than the blocks until catching up with the blocks 66, at which time the velocity of the case and its position on the conveyor system will be determined by the velocity and position of the blocks 66.

It is to be noted in FIG. 4 that the back surface of the blocks 66, that is surface 70, is an inclined surface. While this has certain structural advantages, it also is functional in that in the event of any misadventure occurring under the uncaser head 24, an operator may grasp a case 54 as it is just about to enter the uncasing head and hold it at that point, with the blocks 66 encouraging the cases to an upward position to allow the blocks to slide thereunder as the input conveyor system continues to operate.

The smaller chains 52 extend outward to the position generally indicated by the numeral 72 (FIG. 1). The larger center chain 50, however, extends outward to the position indicated by the numeral 74. Beyond that position may be a conventional roller or ball bearing type unpowered delivery conveyor 76. Thus, cases such as cases **54*a* and 54*b* may be delivered by unpowered conveyor 76 to first engage the larger center chain 50 to be carried along thereby. Prior to position 72, there is provided a pair of sidewise moveable members 78, facingly disposed and driveable into closer separation by compressed air cylinders 80 supporting and driving each end of the members 78. The members 78 are covered on their inward faces with rubber so as to be frictionally engageable with the sides of cases to retain the cases at that position, allowing the chain 50** to slide thereunder.

There is further provided three photoelectric sensors 82, 84 and 86. These sensors, as shall be subsequently described in detail, are for sensing the position of cases 54 to provide for the timely release of case **54*a* with respect to the cooperative position of a pair of blocks 66 on the smaller chains, so that the released case will come to rest against the blocks before entering under the uncaser head 24**.

Figures 5, 6:
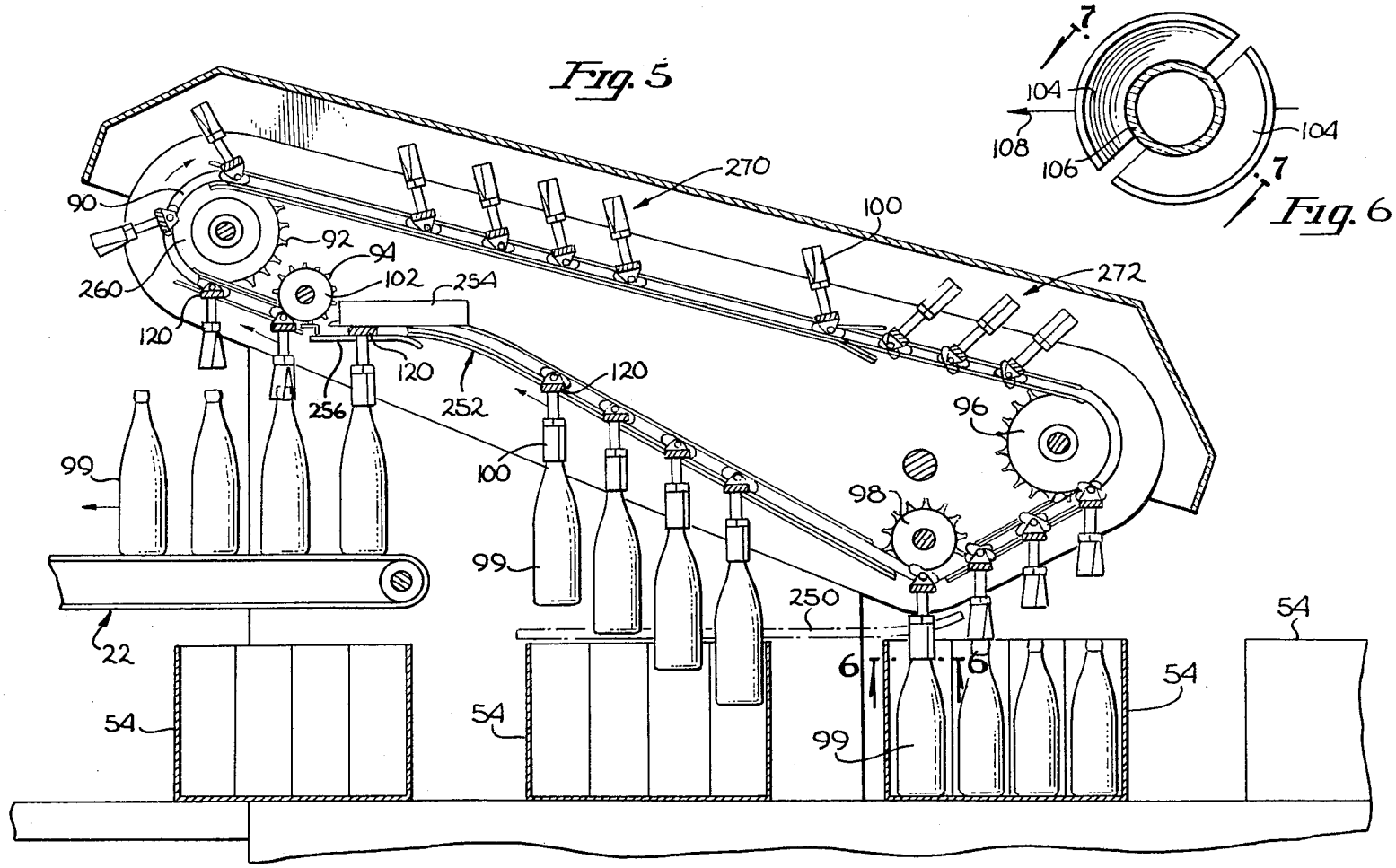
FIG. 5 is a cross-section taken along line 5—5 of FIG. 1.
FIG. 6 is a cross-section taken along line 6—6 of FIG. 5.

Now referring to FIG. 5, a cross section taken along lines 5—5 of FIG. 1, illustrating the basic operation of the uncasing head 24, may be seen. The uncasing head utilizes a pair of continuous chains, indicated by the numeral 90, at each side thereof, with the chains being guided in a predetermined path by a combination of sprockets 92, 94, 96 and 98 as well as by various slide tracks between sprockets to support and guide the chain. Mounted between the chains are a plurality of cross bars 120, each supporting grippers 100, which are adapted to grip the necks of the bottles just below sprocket 98, to support the bottles as they are lifted from the cases, and to release the bottles as the grippers pass by rollers 102 mounted on the same shaft as the sprockets 94.

The construction of the individual grippers is illustrated in FIGS. 6 through 10. FIG. 6 is a view taken along the line 6—6 of FIG. 5, illustrating the general orientation of the grippers in the uncaser with respect to the path of the cases thereunder. In particular, two gripper members 104 are adapted to close on the neck of a bottle 106, with the gripper members 104 being split into separate members along a plane inclined at 45 degrees with respect to the directional motion of the cases, generally indicated by the arrow 108. The purpose of inclining the grippers in this manner is to allow the greater separation of the gripper members 104 when the gripper is in the open condition without interference with the adjacent grippers. This forty-five degree inclination is also indicated in FIG. 5. However, in the remaining figures, that is FIGS. 6 through 10, for purposes of illustration and clarity, the plane separating the two gripper members 104 has been oriented in the fore and aft direction so as to allow a more illustrious description of the operation of the grippers. Such an orientation is of course both operative and satisfactory, though the forty-five degree inclination previously described allows greater room, particularly for gripper patterns for smaller bottles.

Figure 7:
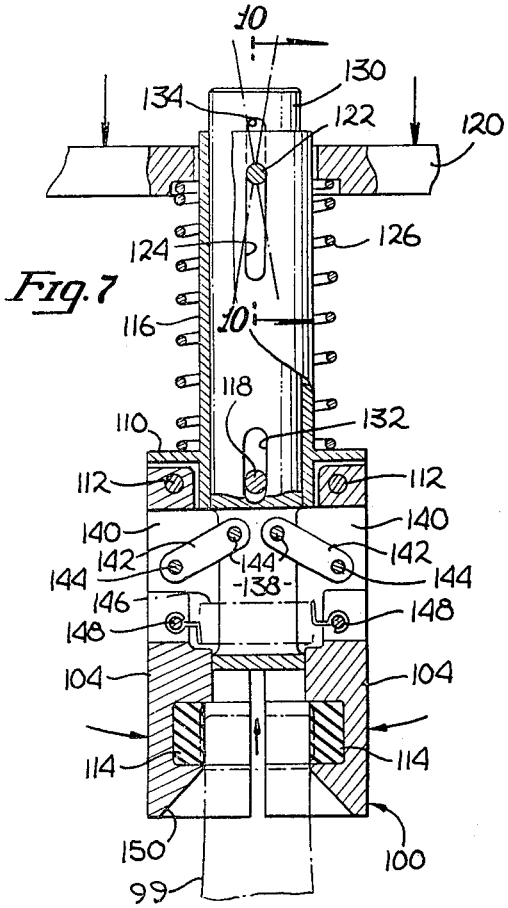
FIG. 7 is a cross-section taken along line 7—7 of FIG. 6.
Figure 8:
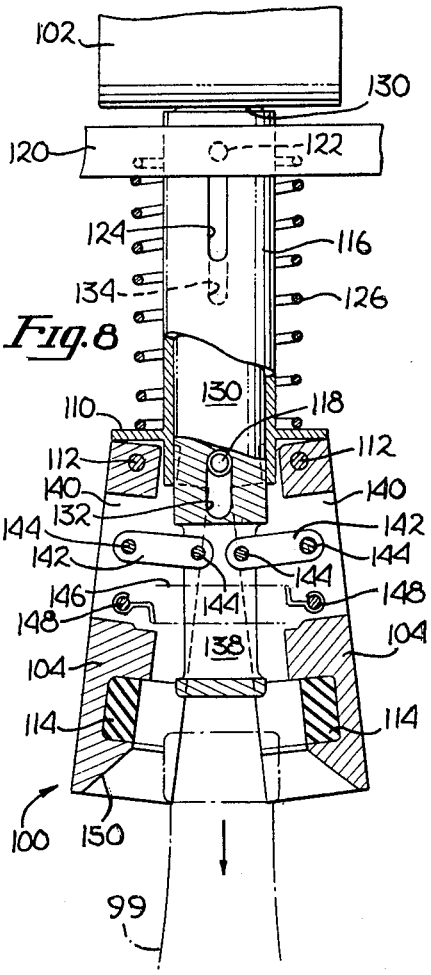
FIG. 8 is a partial cross-section similar to the cross-section of FIG. 7 illustrating the grippers in the open position.
Figure 9:
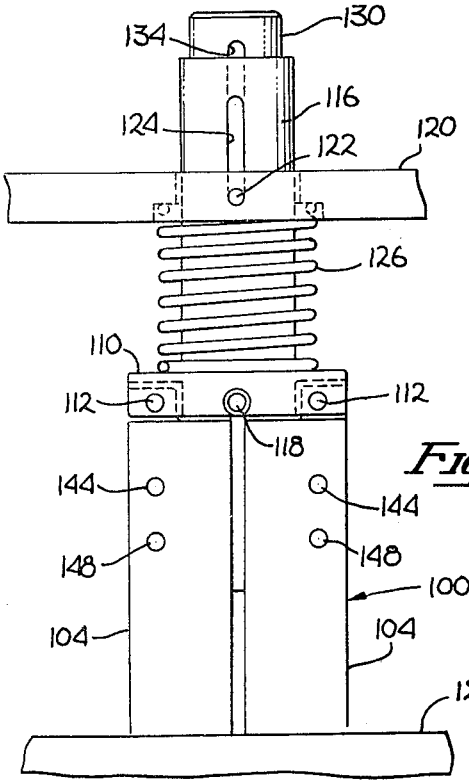
FIG. 9 is a side view of a gripper illustrating the operation thereof upon incurring an obstruction.
Figure 10:
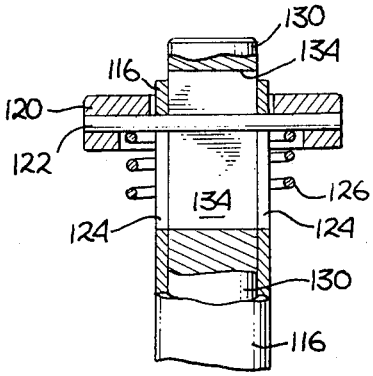
FIG. 10 is a cross-section taken along line 10—10 of FIG. 7.

The grippers are comprised of first and second gripper members 104, together approximately defining an annular structure. Each of the gripper members 104 extend upward into an appropriately disposed support member 110, and are rotationally supported thereby by pins 112. Thus, the gripper members 104 may rotate about the pins from a closed position as indicated in FIG. 7 to an open position, indicated in FIG. 8. The gripper members 104 are provided with rubber inserts 114, disposed so as to be engageable with the neck or top of a bottle to provide increased friction therewith and to cushion the impact of the gripper members onto the bottle top. The support members 110 are retained to a metal cylindrical member 116 by a pin 118. The cylindrical members 116 extend upward to be retained by a cross member 120, forming a portion of the transport means, by a pin 122. The cylindrical member 116 has a slot 124 therein so as to be moveable, within limits, in a vertical direction. A coil spring 126, extending between member 110 and a cross member 120, yieldably encourages the gripper assembly into the position shown in FIG. 7, but upon striking an object such as the base of an upside down bottle 128, the gripper assembly may move upward with respect to the cross bar 120 by the compression of the coil spring, as shown in FIG. 9.

Within the cylindrical member 116 and extending downward between the two gripper members 114 is an actuator member 130. This member extends upward above the top of cylindrical member 116 and downward so as to be engageable with the top of a bottle as shown in FIG. 7. The actuator member 130 is adapted for vertical motion within the limits defined by the slot 132 in the actuator member through which pin 118 passes. The actuator member 130 also has a slot 134 through which pin 122 passes, so as not to restrict motion of the actuator member by the pin 122. The actuator member has a large slot 138, which is cooperatively disposed with respect to slots 140 formed in the gripper members 104. Within these slots are a pair of coupling members 142 each coupled to the actuator member and one of the tripper members at the ends thereof by pins 144. Adjacent the bottom of slots 140 (the slots being somewhat narrower in this region) is a coil spring 146 loaded in tension and supported as shown by pins 148. Thus, with the actuator member 130 in the position shown in FIG. 7, coil spring 146 encourages the two gripper members into closer proximity, thereby forcing the rubber inserts 114 against the top portion of the neck of a bottle 99. When engaging a bottle as shown, the pin 118 does not quite engage the bottom of slot 132, so that the actuator member 130 will not restrict the closing of the gripper members 114.

The cross members 120 are supported at the ends thereof by the chains 90 (FIG. 5) in a manner to be subsequently described in greater detail. However, it is to be noted that at the release point for the bottles, the cross bars 120 pass under rollers 102 which are aligned with the grippers. This is shown in detail in FIG. 8, where it is shown that a roller 102 is disposed so as to engage and depress the top of the actuator member 130, thereby forcing the gripper members 104 to the open position and further deflecting the coupling members 142 past "center" so as to lock the gripper assembly at that condition by the orientation of the coupling members 142, the coil spring 146 and the engagement of pin 118 with the top of the slot 132 in the actuator member. It should be noted also that when the gripper is open, as shown in FIG. 8, thereby releasing the bottle 99, the gripper may still be forced upward against the coil spring 126 in the same manner as shown in FIG. 9. Further, it should be noted that since the gripper is normally supported by the engagement of pin 122 with the top of slots 124 in member 116, thereby supporting the assembly fore and aft of the actuator member, engagement of the actuator member 130 with the roller 102 provides an aligning force on the gripper, encouraging it to remain in the vertical orientation.

When a gripper progresses to a position just below sprocket 98 (FIG. 5) the lower end of the actuator member 130 will engage the top of bottle 99 so as to be forced slightly upward, thereby tripping the over-center mechanism and allowing the coil spring 146 to pull the gripper members 104 against the side of the neck of the bottle, and forcing the actuator member 130 further upward. Thus it may be seen that the gripper members 104 are coupled to an over-center mechanism or toggle mechanism, which may retain the grippers in the open position but allow the rapid triggering of the mechanism for the engagement of the actuator member with the top of a bottle to provide almost instantaneous gripping of the neck of a bottle. In the event no bottle is disposed beneath the gripper as it passes sprocket 98, the gripper will remain in the open condition until again passing sprocket 98 and engaging a bottle. Similarly, once the grippers are opened by roller 102, they will remain open until engaging a bottle so as to close. Thus it may be seen that the rubber inserts 114 both cushion the impact of the gripper members 104 with the neck of the bottle, and further provide a relatively high frictional force therewith, (the gripper members 104, coupling members 142 and the actuator member 130 in the preferred embodiment are of the self lubricating molded plastic).

The lower portion of the gripper members have a chamfer 150 thereon so as to encourage the alignment of the gripper with the top of a bottle as it proceeds downward into a case. For this to be accomplished in the event of misalignment, a bottle neck may generally be horizontally deflected for gripping. To further accomodate this action, the hole in the cross member 120 through which metal cylindrical member 116 passes is purposely made a predetermined amount larger than the cylindrical member so as to allow for some sidewise delfection of the lower portion of each gripper to align the gripper with the bottle. This sidewise motion, however, is limited by the binding of cylindrical member 116 with the hole so as to prevent the sidewise deflection from being excessive as to interfere with the operation of the neighboring grippers.

Now referring to FIGS. 11 through 14, and with reference to FIG. 5, certain of the details of the transport means may be seen. Each of the cross members 120 has a small metal end plate 152 fastened thereto. A cam member 154 has an axle pin 156 fastened thereto by a retaining pin 158. The axle pin 156 extends through a hole in the end plate 152 and is retained with respect to the end plates by a coil spring 160 and snap ring 162. Thus, cam member 154 is yieldably encouraged toward engagement with end plate 152. A pair of balls 164 are disposed in pockets in the face of cam member 154, so as to be encouraged into mating holes 166 in the end plate. Thus, the cooperative function of these parts is to provide a detent by the engagement of the balls with the openings 166 to yieldably lock the cam members 154 in a predetermined position with respect to the end plate. Thus, if cam members 54 are restrained in their rotation, end plates 152 may be forced by an inadvertant extraordinary force to rotate from the detent position, though the end plates will remain in the detent position under normal conditions.

The axle pin 156 extends outward into a hole 172 in a chain slide member 170. The chain slide member 170 in turn has a pair of pins 174 pressed therein, which pins have a spacing so as to be insertable into a pair of hollow pins of the chains 90 providing the basic drive for the transport system. The lateral disposition of the grippers and the number of grippers disposed on a crossbar 120 will depend upon the lateral distribution of bottles within a case. Similarly, the longitudinal disposition of bottles within the cases will determine the separation between adjacent crossbars. Since the spacing of bottles may not be in fixed relation to the chain length dimensions in the preferred embodiment, three functionally equivalent but dimensionally different chain slide members 170 are provided so that the cross members 120 may be spaced within a matter of few tens of thousandths of an inch from the ideal location. In particular, the holes 172 in these three chain slide members are located at different positions with respect to the pins 174 therein. Thus, since none of the chain slide members have the pins centered, six cross bar positions may be selected by using either of two positions for either of the three standard chain slide members. Also, obviously changes in spacing may be readily made, if necessary, due to the lack of permanent attachment to the chains.

Now referring specifically to FIG. 11, it will be noted that each of the side plates 200 of the uncase head assembly 24 are provided with channels defined by channel plates 202 having a self lubricating plastic liner 204. These channel plates are generally provided throughout the path of travel of the chains 90. The channel plates retain chain 90 at both sides of the assembly. On the right hand side of FIG. 11, it may be seen that the channel plates further extend in and provide a slide for chain slide members 170. On the left hand side of this figure, the channel plates provide a slide region not only for the chain slide members 170, but further extend inward to provide a slide region for cam members 154. Thus, cross member 120 is restrained in rotation about a horizontal axis in FIG. 11 by the retention of the cam member 154 between the channel plates on the left hand side of the figure. Thus, this figure is representative of the cross sections in the transport means between the sprockets 96 and 98 (FIG. 5). Accordingly, cam members 154 on one side of the uncaser head (the left side) engage a restraining track in the region between sprockets 96 and 98 so as to retain the cross members 120 in a horizontal disposition in that region (i.e., the grippers in a vertical disposition). Cross-sections taken along lines 12—12 and 13—13 of FIG. 11 showing the two sides and the disposition of the cams are shown in FIGS. 12 and 13 respectively. For purposes of clarity, the various cam members 154 and chain slide members 170 are identified in some of the following figures by the appropriate numerals followed by an "L" or "R" to designate the left or right sides of the transport means as viewed in the direction of movement, i.e., from input conveyor 20 towards delivery conveyor 22. Thus, in FIG. 12, the cam member 154L may be seen in line with the chain slide member 170 L (not shown) immediately therebehind. In FIG. 13, the cam member 154R on the right side of the assembly may be seen not aligned with the (narrower) track or the chain slide member 170R riding therein. Thus, it may be seen that the angular disposition of cross member 120 about a horizontal axis may be controlled by the engagement of either cam members 154L or 154R with extensions of the chain slide track, with FIG. 11 specifically illustrating the alignment of cross member 120 by the left cam member 154 designated 154L in FIG. 12.

Now referring to FIGS. 15, 16 and 17, further details of the transport means may be seen. FIG. 15 is a cross-sectional view taken along lines 15—15 of FIG. 1, showing the right side of the transport means. FIGS. 16 and 17 are cross-sections taken along lines 16—16 and 17—17 of FIG. 1, illustrating the left side of the transport means. As a typical cross member 120, such as member **120*a* shown in FIG. 16, proceeds through the region between sprockets 96 and sprocket 98, it is maintained in a horizontal disposition and therefore the grippers in a vertical disposition by engagement of cam member 154L with the channel plates defining the chain slide region. In the region of sprocket 98, the grippers grip the bottles as hereinbefore described. Similarly, at sprockets 98 as well as in positions beyond sprocket 98, such as the position of the cross member 120*b*, neither cam member is guided or restrained (though the chain slide members are always guided on both sides of the transport means), so that the cross members and the gripper maintain their horizontal and vertical dispositions respectively as a result of the high pendulosity thereof (caused by the bottles hanging therebelow through the pendulosity of the grippers along is adequate for this purpose). It should be noted that in the region between sprockets 96 and 98, the grippers proceed downward at a relatively high rate due to the angle of the track in this region, and further rapidly change direction because of the relatively small size in the sprocket 98 to then proceed upward at the same angle. Consequently, the horizontal component of velocity of the grippers in the downward portion of transport means path in this region is equal to the horizontal component of the grippers in the upward portion of their motion beyond sprocket 98. Consequently, there is no significant relative horizontal component of velocity between the grippers and the cases, as they proceed under the region of sprocket 98. Thus, there is no tendency to longitudinally drag the bottles with respect to the cases or the cases with respect to the bottles, unlike the prior art systems. The lack of said dragging is made possible by the rapid gripping action of the individual gripper upon initial contact with the bottle, which in turn avoids any significant substantially horizontal section of track in place of sprocket 98**.

There is provided a skate like member 250 (FIGS. 2 and 5) disposed just above the path of the cases in the region of gripping, and further disposed so that the bottles pass to either side thereof. This member assures that the cases and/or bottle separaters within the cases are not allowed to rise as the bottles are lifted out of the cases. Once the bottles are lifted free and clear of the cases, the chain guides curve in a region generally indicated by the numerals 252 to define a short section of horizontal track. Slide members 254 and 256 are disposed so as to engage the cross members 120 in this region, to assure that they are horizontal. Accordingly, as the chains pass around sprockets 94, the rollers 102 aligned with each longitudinal row of the grippers, depress the actuating members 130 to open the grippers and release the bottles, thereby allowing the bottles to freely rest on the delivery conveyor 22. At the same time, as may be seen in FIG. 15, the right hand cam member 154R, will engage and be guided by the track in the region between the rollers 102 and the end sprocket 92, thereby assuring that the cross members 120 are maintained in horizontal position during this portion of the path to avoid tipping over the bottles deposited on the conveyor.

Mounted on the same shaft as sprocket 92 and aligned with the trajectory of a portion of the cam member 154R is a circular member 260, which will engage the cam members 154R, causing them to rotate with the member 260 until being deposited into an upper return track, generally indicated by the numeral 262. The return track has a lip member 264 projecting past the edge of member 260 so as to engage the cam followers at that point to assure that they properly enter the return track.

As may be seen from FIG. 5 the grippers as they enter the return track are not at the proper angle with respect to the chain tracks to eventually project perpendicularly downward into the cases at the pick-up point under sprockets 98. Consequently, the angle of the grippers with respect to the chain track must be changed from that of the region generally indicated by the numeral 270 to that in the region generally indicated by the numeral 272. To accomplish this, the determination of the angularity of the cross members 120 must be changed from the right hand cam member 154R to the left hand cam member 154L. To accomplish this changeover, the slide in which the cam members 154R are guided in the initial return path into an expanding region, generally indicated by the numeral 300 (FIG. 15), thereby gradually releasing the previous guidance of the cam members. At the same time, the left hand side of the transport means (FIG. 16) is provided with a decreasing taper in the cam guide region, generally indicated by the numeral 302, so as to gradually change the guidance of the cam members 154 from the hand side to the left hand side, thereby changing the angularity of the cross members 120 as shown. The top view of the right hand track in the region 300 may be seen in FIG. 18. It may be noted therein that the track in the region 320 is sufficiently wide to engage both the chain slide member and the cam member, with the area 322 engaging the cam member tapering and finally terminating so that the track in the region 324 only engages the chain slide member and not the cam member.

Like sprocket 92, sprocket 96 also has a circular member 306 attached thereto to guide the cam members 154L around the sprocket into the section of track leading to the pickup point below sprocket 98. To insure smooth transition of the cam member on and off the circular member 306, projections 308 and 310 adjacent the edge of the circular member 306 guide the cams in this region.

There has heretofore been described a unique gripper for gripping individual bottles by the tops thereof, together with a continuous transport means for causing the grippers to engage the necks of bottles in cases passing thereunder on a first conveyor, and depositing the bottles onto an output conveyor. To achieve the desired result, cases must be appropriately released by the members 78 (FIG. 1) in coordination of the motion of the smaller chains 52 in the input conveyor, so that the cases are aligned with the sets of grippers in the uncasing head. To achieve this result, the photosensors 82, 84 and 86 are used to sense the position of the chain and/or cases and to cause members 78 to release cases at the appropriate time. In particular, each of the photo cells 82, 84 and 86 provide a signal to a control circuit 400, as shown in FIG. 20. The control circuit 400 combines the signals in a predetermined manner to provide a control signal to a solenoid valve in the compressed air line coupled to cylinders 80. Of course, other actuators for members 78 may also be used if desired.

Photo cell 82 is positioned so as to sense a case located between members 78. Photo cell 84 is positioned to sense the passage of a pair of reference blocks 66 in the smaller chains, and photo cell 86, positioned a case length forward of photo cell 82, is positioned at an elevation so as to sense passage of a case, but not the passage of only a pair of reference blocks 66. Whenever the photosensor 82 is illuminated, members 78 should be in the withdrawn position, since such a condition indicates that no cases are either in proper position between members 78 or are passing beyond that region toward the uncasing head. When the first case reaches the photosensor 82, the control circuit will cause members 78 to close on the case to retain it at that position. When the photosensor 84 senses the passage of a pair of reference blocks 66, the control circuit will cause members 78 to be withdrawn to release one case which eventually will catch the corresponding pair of blocks. It will be noted, however, that assuming there is a supply of cases behind the case released, a steady stream of cases would be delivered to the uncaser, thereby keeping both photosensors 82 and 84 dark and holding members 78 in a withdrawn position. To avoid this, the photosensor 86 is provided to sense the passage of cases thereby. Thus, when photosensor 86 first goes dark, the control circuit causes members 78 to close on a case. A time delay in the control circuit causes photosensor 86 to maintain members 78 in a closed position until the end of the case sensed by photosensor 86 at least passes the photosensor 84, at which time photosensor 84 itself will cause members 78 to be in the closed position until sensing a subsequent pair of reference blocks 66. Thus, it may be seen that the signals of the photosensors are logically combined in the control circuit, to cause the periodic opening and closing of members 78 to release cases in a coordinated manner with respect to the reference blocks 66 on the small chains, so that cases may be delivered to the uncasing head in synchronization with the operation of the transport means in the head.

Since the transport means in the uncasing head must be synchronized with the input conveyor system, a means should be provided to advance or retard the operation of the uncasing head to achieve this synchronization. In the preferred embodiment, the uncasing head drive is provided through a driven sprocket 500 and chain 502 with an idler sprocket 504 and a second idler sprocket 506 to allow for a chain pick-up during adjustment of the height of the uncasing head. Synchronization may be achieved in part by changing the engagement of chain 502 by the desired number of links with respect to the teeth of sprocket 508 on the uncasing head. To provide for a even more accurate adjustment, a special adjustment mechanism is provided with sprocket 508 as shown in detail in FIG. 19. In particular, the sprocket 508 is adapted for free rotation from the shaft 510 but is bolted by bolts 512 to a member 514 which is keyed to the shaft by key 516. The bolt 512 passes through slot 518 in member 514 so that the bolts may be loosened and the sprocket turned the desired amount up to at least one chain link length to achieve the fine adjustment desired.

Figure 21:
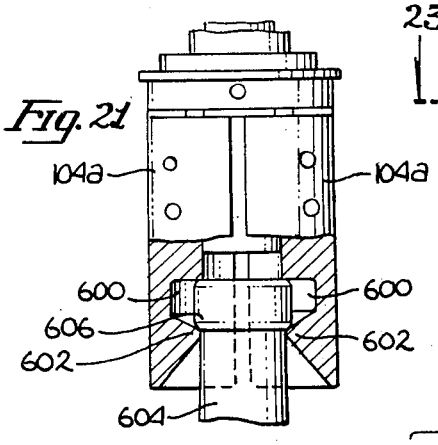
FIG. 21 is a partial cross section of an alternate gripper design.
Figure 22:
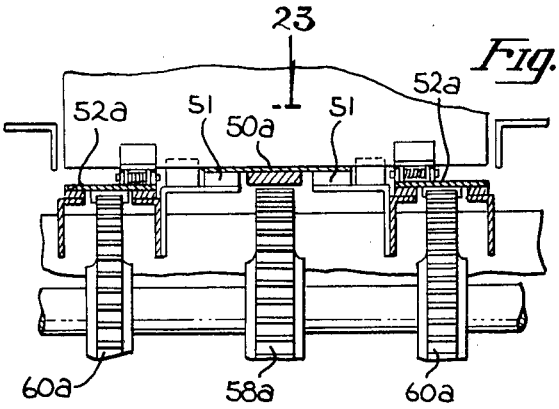
FIG. 22 is a view of the drive sprocket system for the alternate conveyor system for the present invention.
Figure 23:
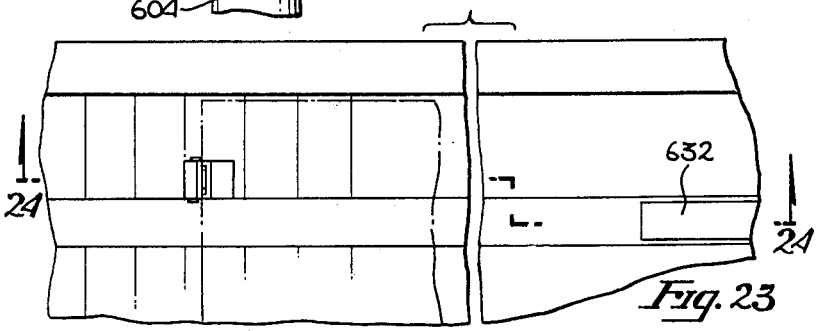
FIG. 23 is a top view of the conveyor of FIG. 22.

An alternate gripper design is shown in FIG. 21. In this gripper, otherwise identical to the gripper hereinbefore described, the gripper members 104A each have a relief 600 proportioned so that the lower lip 602 thereof engages the neck of a bottle 604 just below the top flange 606. Accordingly, gripping in this embodiment is by way of mechanical engagement, as opposed to frictional engagement. In this manner, positive gripping is assured even with wet and/or slippery bottles.

An alternate case transport and synchronizing means is shown in FIGS. 22 through 27. In this embodiment, the chain sprockets 60A and 58A are the same size, so that the outer chain members 52A and the inner chain members 50A travel at the same surface speed. However, the inner chain members 50A are spaced further outward in the operative part of the track between sprockets by the spacers 51, fixed to the conveyor frame, so that the center chain members 50A are higher than the outer chain members 52A in the operative part of the track.

Figure 25:
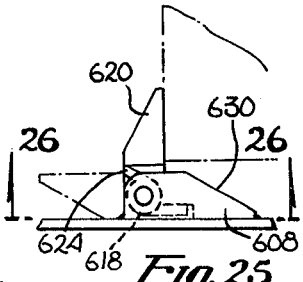
FIG. 25 is an enlarged view of one of the cleats taken along line 25—25 of FIG. 24.

At various positions along chain members 52A are welded cleat mounting members 608 with a predetermined spacing to coincide with the case spacing requirements for synchronization with the groups of grippers on the uncasing head. The cleat mounting members 608 have rearward extending flanges 610 to accept a pivot pin 612. The cleat mounting members are also provided with a groove 614 at the bottom thereof to receive an end 616 of a coil spring 618. Cleats 620 are provided with flanges 622 which are supported by pins 612 and are also provided with a slot to receive a second end 624 of the coil spring 618. In this manner, cleats 620 are spring loaded to the vertical position as shown in FIG. 25, but upon sufficient force will deflect to the position shown in phantom in that figure. Also, the thickness of the cleats and the cleat mounting members is approximately equal to or less than the spacing provided by spacers 51, so that when deflected into the position shown in phantom in FIG. 25, the center chain members 50A will hold the case above both the cleat mounting members and the cleats. In addition, the leading edge 630 of the cleat mounting member 608 is tapered so as to encourage a case upward in the event any part of the case extends downward in that region. Finally, there is provided a pair of skid-like members 632 between the inner and outer chains, which members are slightly higher than chain members 50A. The skid members 632 are located at a position just before the cases proceed under the uncasing head and provide the final synchronization of the cases by raising the case off of chain members 50A and stopping the case until the next set of cleats 620 engage the case and encourage the case onward under the uncasing head.

Accordingly, in this embodiment the cleats 620 provide a positive drive to the case by pushing the case from behind, though if the case meets some obstruction, cleat members may deflect downward to allow the chain to continue even though the case has stopped. The advantage of this positive drive from behind is that it provides a driving force to continue the motion of the case in the presence of retarding forces such as those that may be encountered when using case strippers, that is, a stationary member mounted between rows of grippers to engage the top of the case and to prevent the case from lifting upward when the bottles are removed therefrom. Such strippers and other factors have a tendency to retard the case which may cause some wedging of the bottles in the case and resistance to their being lifted therefrom by the grippers. Thus, it may be seen that by using the cleat system, as hereabove described, ideal synchronization and drive for the cases is obtained provided there is also a means for releasing cases one at a time at any point between cleats.

Figure 27:
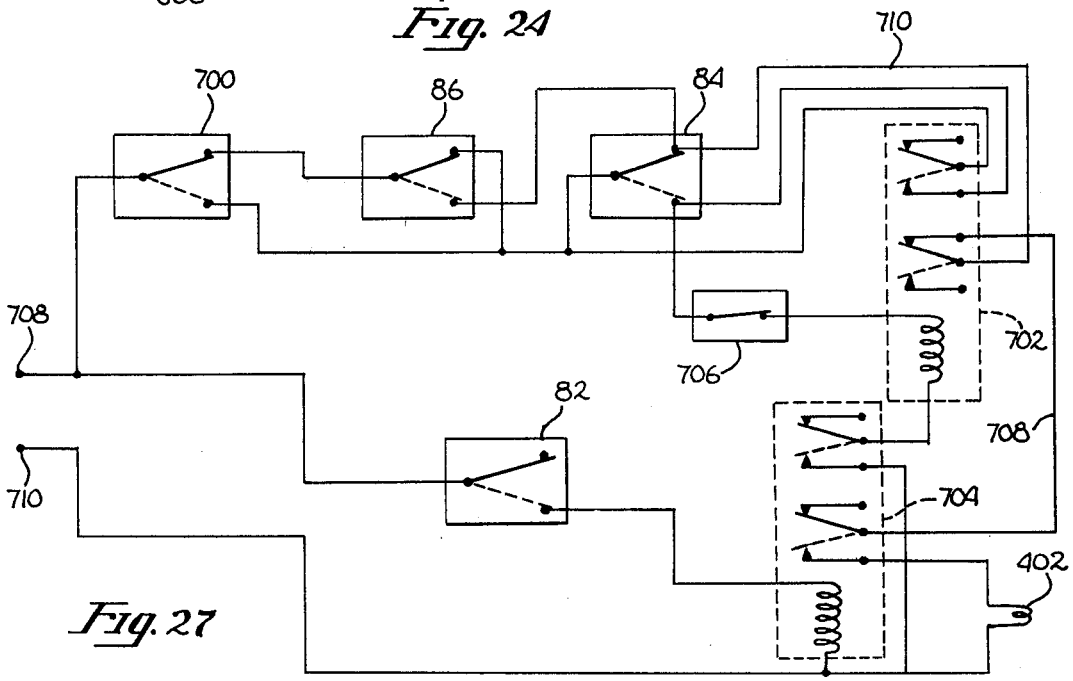
FIG. 27 is a circuit diagram of the case synchronizing system utilizing the alternate conveyor construction of FIGS. 22 through 26.

An alternate circuit diagram for achieving the required release is shown in FIG. 27. In this system, four photosensor switches and two double pole, single throw relays are used. Three of the four photosensing switches are generally located in the same positions as the three switches utilized with respect to the previously described system, and accordingly for easy reference with respect to FIG. 1 are again given their previous numbers. The fourth photoswitch, also indicated on FIG. 1, has been identified as switch 700. The two relays are numbered 702 and 704, and in addition to the solenoid valve 402 there is also provided a switch 706 operated in conjunction with the main power control to the bottle conveyor power system.

All of the photoswitches are shown in their illuminated position, and each will change to the opposite position shown in phantom when the photosensor is dark. Similarly, the relay contacts are shown in the unenergized condition. Power is applied on terminals 708 and 710, which in the preferred embodiment is 24 volts DC. It may be seen that as long as the case position sensor 82 is illuminated, relay 704 will be unenergized, and accordingly the case stop solenoid valve 402 cannot be operated regardless of the condition of the other three photoswitches and the condition of relay 702. Thus, when the system has started without any cases therein, the solenoid valve will be unactuated and the movable members 78 (see FIG. 1) will be withdrawn. Accordingly, when the first case then enters the system photo switch 82 will sense the edge of the case, which in turn will energize relay 704 to change the switch contacts to that as shown in phantom in FIG. 27. This couples the solenoid 402 through line 708 to relay 702. However, it may be seen that power will not be delivered through relay 702 to line 708 unless the relay 702 is unactuated and power is applied thereto through line 710. These conditions depend in part upon the state of the switches 700, 86 and 84 as well as, in certain situations, the past history of these switches. There are a great number of possible states for these switches, only some of which will be described in detail herein as all are readily traceable by proceeding through the normal operating modes of the sequential machine by anyone of ordinary skill in the art.

When the uncaser is first turned on with no cases being delivered thereto, the photoswitch 82 which senses a case in position between members 78 awaiting a synchronized release is illuminated. Relay 704 is unenergized, and thus solenoid valve 402 is off. Accordingly, members 78 are in the withdrawn position and will allow a case to enter therebetween until the photoswitch 82 goes dark. While it is possible that this may occur at the desired synchronized time, in general this will not be true, and photoswitches 700, 86 and 84 will all be illuminated. Accordingly, power is delivered through these three photoswitches through the lower set of switch contacts and through line 78 to the solenoid valve 402, thereby actuating the valve to close members 78 against the case to maintain it in that position. When a pair of cleats pass the cleat photoswitch 84, that switch momentarily goes dark. This actuates relay 702, which latches in the actuated position because of the connection of the upper set of switch contacts therein, thereby turning off solenoid 402 and releasing the case at that time. Of course, photoswitch 82 remains dark, and while the cleat photoswitch 84 will be illuminated immediately after the cleat passes, it will again go dark very shortly thereafter, as the leading edge of the just released case starts past the photoswitch.

Photoswitch 86 is preferably located along the conveyor very slightly greater than one case length from the photoswitch 82. Accordingly, when switch 86 goes dark, indicating the arrival of the leading edge of the case at that point, solenoid 402 will again be turned on (providing switch 82 is still dark, indicating a supply of cases) to stop the flow of cases until the next case is to be released. When switch 86 first goes dark, cleat photoswitch 84 will also be dark, sensing not a cleat but the case itself. As the case continues, its trailing edge will soon pass the cleat switch 84, allowing that switch to be illuminated. This signal from cleat 84 could be used to enable the release of the next case when cleat switch 84 again goes dark upon the passage of a cleat. However, in the present embodiment a signal from photoswitch 700 is used to enable the release, which signal is actuated by the darkening of the photoswitch 700 by the leading edge of the case just after the trailing edge passes switch 84. Thus, just after the trailing edge of the case passes photoswitch 84, allowing it to be illuminated, photoswitch 700 goes dark (photoswitch 86 already being dark). This enables the cleat photoswitch 84 (i.e., resets the system), causing the actuation of solenoid 402 upon the next passage of a pair of cleats past photoswitch 84 to release the next case. Accordingly, cases are individually synchronously released as required, so as to allow the cases to proceed initially along the conveyor, each located between two sets of cleats. Of course, after passage beyond the photoswitch 700, the cases are lifted slightly as hereinbefore described so as to be stopped until the set of cleats immediately therebehind catches up with the case and provides a positive (though yieldable) drive for the case under the uncasing head even in the presence of ski-like members to hold the case down against the lifting forces of the individual bottle grippers.

The above described embodiment for the circuitry and photoswitches to control the synchronization of the cases performs three important functions, among others. These are:

1. It provides a latch to release a case upon the momentary passage of the cleat past a predetermined position.

2. It provides a means for sensing the arrival of the next case between the members 78 for temporary retention at that point (which may not be sensed by the case position sense photoswitch 82 alone because that switch will be maintained permanently dark by a continuous flow of cases) and 3. It provides a means for resetting or enabling the cleat photoswitch 84 so as to allow the release of the next case the next time the cleat photoswitch 84 goes dark sensing the passage of a pair of cleats therebetween.

Of course, this last requirement could be eliminated by placing the cleat photoswitch 84 at an appropriate position below the case trajectory, such as approximately level with the axis of the forward chain sprockets and forward thereof so as to sense the passage of the cleats in their upward travel at that point. Of course, other modifications to the sensor location and the circuitry may also readily be made by one skilled in the art to achieve the desired result. Applicants have found, however, that photosensors placed where they may readily be observed together with the relays provide an easily maintained, easily tested and highly reliable system, which may be manufactured at a relatively low cost. Also by using photoswitches having adjustable mounting, adjustment in the position thereof may be made so as to achieve preferred operating sequences with varying size cases.

There is described herein a reliable, high speed full depth uncaser with a variety of safety and other operational features, the frame and conveyor system of which may also receive an alternate type of uncasing head for uncasing half depth uncasers. Of course, for such operations, members 78 would be maintained in the withdrawn condition so that a continuous flow of cases could be delivered to the half depth uncaser, and reference blocks 66 would generally be removed (or folded downward) so as to not be operative. Thus, the full depth and half depth cases may be uncased at the same station and utilizing much common equipment.

There has so far been described herein the preferred embodiment of the present invention. It is to be noted, however, that alternate embodiments may be readily fabricated by one skilled in the art. By way of example, an embodiment could easily be fabricated wherein cases would be delivered to a larger uncasing head in a sidewise orientation so as to effectively increase the speed of the uncaser without any increase in the linear velocity of the transport means. Similarly, the transport means within the uncasing head could be provided with groups of grippers in two or more case patterns, with appropriate changes in the case sensing and operation of the case holding members 78, so that cases of either two or more types could be released in synchronism with the corresponding grippers, thereby allowing one uncasing head to uncase more than one type of full depth case. Of course, other features may also be provied, such as by way of example, the guard 550 normally diposed outward and above the cases to detect any obstruction in cases projecting above that level. Such a guard is pivoted at point 552 and is adapted to actuate a micro-switch 554 to turn off the machine, should an obstruction force the guard 550 upward. Similarly, portions of the cover 556, generally at each end for the transport means are hinged for access to the transport means and may be provided with similar micro-switches which are to turn off the machine whenever the covers are tilted opened by an operator or by an obstruction in the transport means.

Figure 28:
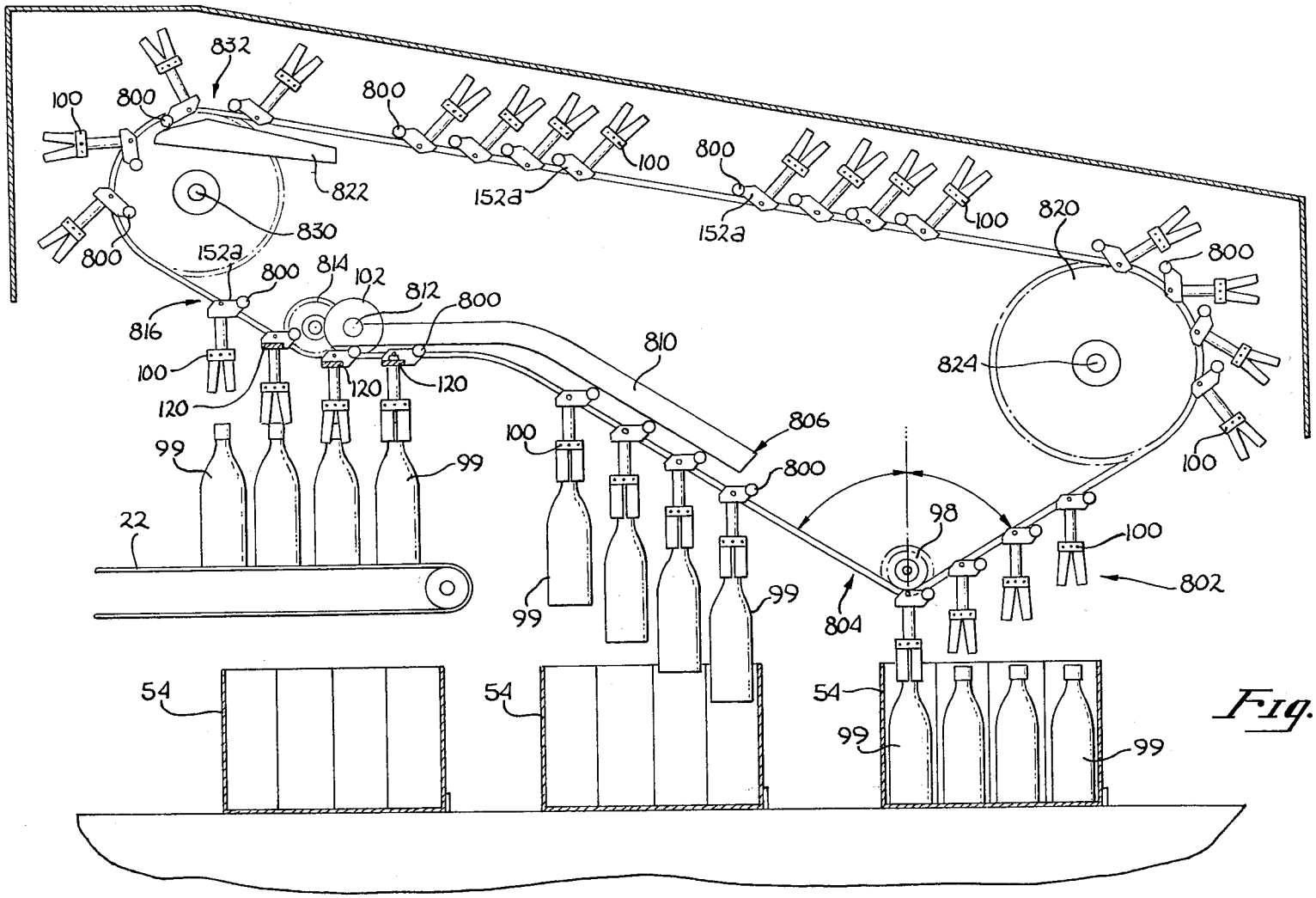
FIGS. 28 through 33 are views of an alternate embodiment having particularly high speed capabilities.

Now referring to FIG. 28, a view similar to that of FIG. 5 illustrating another embodiment of the invention may be seen. This embodiment is functionally the same as the embodiment of the uncaser head hereinbefore described though has certain improvements therein making it highly desirable for use in high speed applications and/or applications involving the handling of particularly low weight containers such as the newer plastic containers. The primary differences between this embodiment and the prior embodiment reside in the manner and the locations of restraining the crossbars 120, the location of the actuation of the actuator member 130 on the individual grippers and the position during the return portion of the gripper trajectory at which the gripper attitude is shifted from a trailing condition to a leading condition in readiness for the next gripping cycle. In addition, the input conveyor system has been changed somewhat, specifically to adapt the system to the particularly high speeds at which this embodiment is capable of operating.

Figure 31:
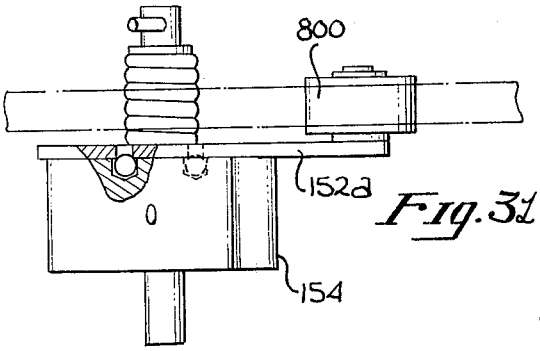
Figure 32:
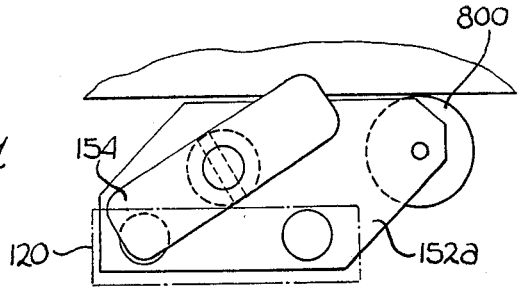

In the previously described embodiment, the angular orientation of the crossbars 120 with respect to the adjacent supporting chain was in some regions not controlled, being determined in various other regions by the left cam member, the right cam member or, in the region just prior to release, by the slide members 254 and 256. In this embodiment, the left end plates 152*a* (similar to the metal end plates 152 of FIG. 14) extend to support a small plastic self-lubricating roller 800. As may be seen in FIG. 28 and in greater detail in FIGS. 31 and 32, the metal end plates support the rollers 800 at an elevation above the crossbars 120 (see FIG. 32) when the crossbars are themselves oriented to support the individual grippers 100 in a generally vertically downwardly directed orientation. In addition, the rollers 800 and cam members 154 are disposed on opposite sides of the metal end plates 152*a* so that the guide members may contact the rollers 800 without interference from the channels guiding the chain slide members 170 and which guide the cam members 154 at some locations. The purpose of these rollers may be best seen with respect to FIGS. 28 and 30 through 32. In particular, in the downward portion of the gripper path generally indicated by the numeral 802, the crossbars 120 are maintained level by the engagement of the left cam members 154 with the left chain slide channel. As the grippers reach the gripping position and pass under the sprockets 98, the cam members are no longer guided by the chain slide channels, so that grippers are free to reorient slightly as required for the gripping and for the withdrawing of the bottles 99 from the cases 54. Normally, regardless of the speed of operation of the equipment, there is very little swinging of the grippers and the bottles held thereby during the initial upward movement of the grippers in the region generally indicated by the numeral 804, since the downward inclination in region 802 is the same as the upward inclination in region 804, yielding the same horizontal velocity component for the grippers in these two regions. (Also sprocket 98 is purposely made relatively small so that its influence is small). However, it will be noted that the grippers in the horizontal portion of the gripper path at the delivery conveyor 22 have a higher horizontal velocity than the grippers in regions 802 and 804 so that, particularly in a high speed machine, the grippers and the bottles supported thereby will tend to tilt away from the vertical in a lagging direction unless restrained from doing so. Even in a low speed machine the same characteristic has been encountered to varying degrees because of the friction in the crossbar support structure and the rotation of the chains from an upwardly directed to a horizontal chain path. To avoid this characteristic and to better define and restrain the vertical orientation of the grippers and the bottles being held thereby, the right cam members, having an angular orientation corresponding to the direction of the path of chain travel in region 804, are captured by extensions of the chain guide channels in approximately region 806. These channels locally open up somewhat as the horizontal portion of the trajectory over the delivery conveyor 22 is approached, so that in this area the lead portion of the right cam members 154 (see FIG. 29) are restrained by a lower slide member 808 to restrain the cross bar from rotating to prevent the grippers and bottles supported thereby from swinging forward. Since the grippers generally accelerate rather than decelerate as they approach the delivery conveyor 22, the force normally exerted by the right cam members 154 on the slide surface 808 is relatively low, being functional primarily to prohibit the forward swing of the grippers which might be encouraged by vibration or upon shut down of the machine. At the same time, however, the rearward swinging of the grippers and bottles supported thereby caused by the acceleration in this region is restrained by the engagement of the rollers 800 with a guide bar 810 fixed to the head of the uncaser and appropriately disposed for this purpose. Thus while the grippers hang free in the region 804 the crossbars are effectively captured starting approximately at region 806 and constrained to the horizontal disposition as the chain path levels off in the release region.

In the previously described embodiment, the actuators on the individual grippers were actuated by rollers 102 supported on the same shaft as spocket 94 (see FIG. 5). Since the direction of the chain path is changing in this region, it is difficult to restrain the orientation of the crossbars against the forces exerted thereon by the rollers. In this embodiment, however, the rollers 102 are supported on a separate transverse shaft 812 forward of the sprocket defining the chain path direction change so that the actuators are pushed to the released position during the horizontal portion of the gripper motion at which time the gripper orientation is positively defined by the rollers 800 and the guide bars 810, and the right cam members 154 and slide 808. Thus even though the orientation of the crossbars 120 is not positively defined in the region by the sprocket 814 there are no forces disturbing the grippers and crossbars at this point, so that they remain steady with the desired vertical orientation. In that regard, it should be noted that the horizontal component of the chain and thus crossbar and gripper velocity in the generally upward directed region indicated by the numeral 816 is slightly less than in the horizontal section during which gripper release is effected. The difference in horizontal velocity does not accummulate to any significant positional difference prior to the gripper lifting free of the top of the bottles 99 being released so that no disturbance of the bottles is caused thereby.

Figure 30:
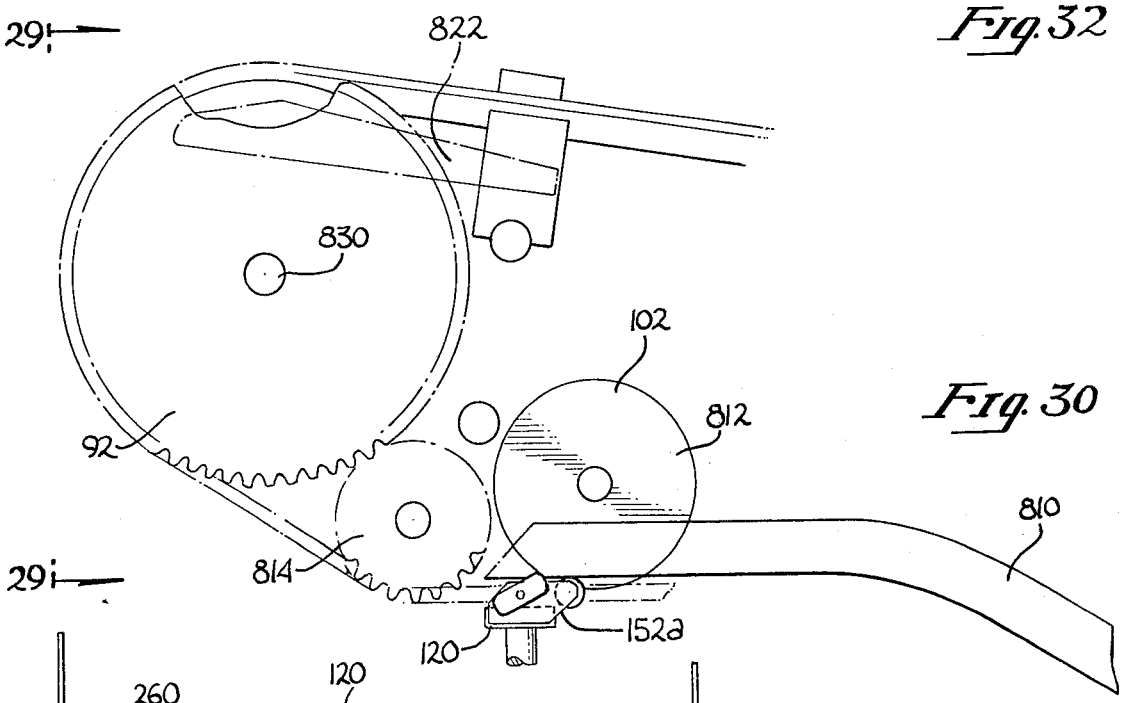
Figure 29:
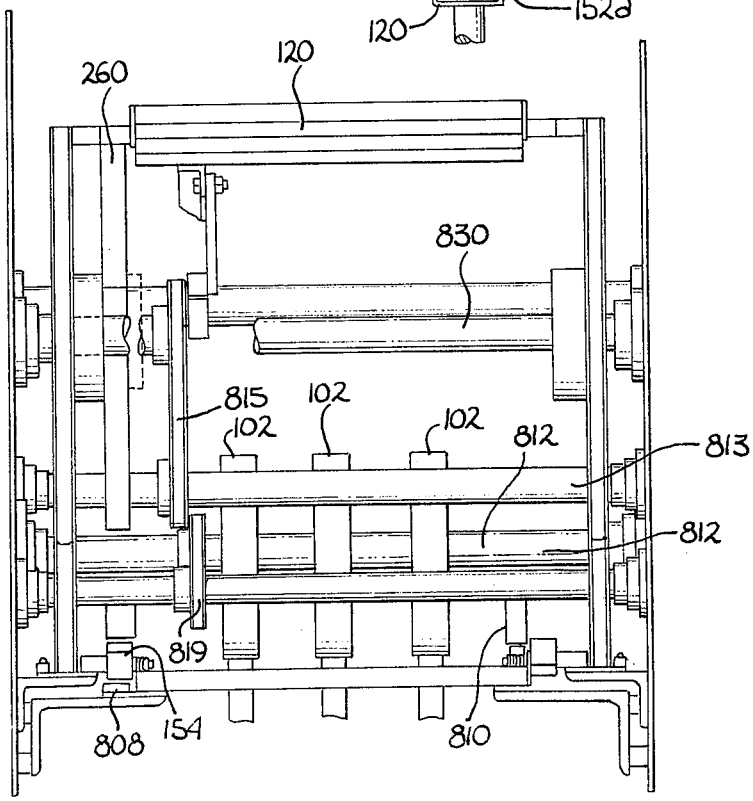

Referring now to FIGS. 29 and 30, the drive system for this embodiment may be seen. In that regard it will be noted from FIG. 2 that in the earlier embodiment power for the uncaser head generally indicated by the numeral 24 in that figure is delivered through chain 502 to sprocket 508. Since one aspect of the invention is the provision of a universal base conveyor system on which either a half depth uncaser head or a full depth uncaser head may be mounted it is preferred to maintain that interchangeability with respect to the high speed head also. Accordingly, a shaft 813 is provided at the same location relative to the mounts for the head as shaft 510 (see FIG. 15) of the earlier embodiment. Thus shaft 813 is driven from below through a chain sprocket arrangement as shown in FIG. 2, with shaft 813 driving the upper sprocket shaft 830 through chain 815 (FIG. 29) and associated sprockets. This provides a drive for the left and right main chains supporting the cross bars, with sprockets 820 and 98 at the forward region of the transport system (see FIG. 28) being driven thereby. In addition, the sprocket 814 on shaft 817 is driven by the left and right chains which in turn drives shaft 812 supporting the release rollers 102 through chain 819 and associated sprockets.

In this embodiment, the upward slope of the region 816 is the same as the upward slope in the region 806 so that once a guide bar passes the sprocket 814 (FIGS. 28 and 30) the right cam member may again be captured in the chain slide channel so as to constrain the angular orientation of the crossbars 120 until reaching the region of the sprocket 92 and drum 260 (see FIGS. 29 and 30). At this point the right cam member is engaged by the drum 260 so as to be retained tangential thereto until reaching the point where the chain and cam member start to diverge from the sprocket and cam member for the return to the forward sprocket 820. At this point rollers 800 engage an appropriately disposed cam plate 822 (see FIGS. 28 and 30) to rotate the grippers and crossbars forward to the appropriate angular orientation for the next gripping cycle. At this orientation, the left cam member is captured by an extension of the chain slide channel so as to set the angular orientation of the grippers during the upward return path. (A drum on the forward shaft 824 similar to drum 260 on the upward shaft maintains the left cam members tangent thereto, with the chain slide channel also guiding the left cam members in the region 802 down toward the pickup or gripping position). It will be noted that in the previously described embodiment, the position in which the orientation of the gripper was altered during the return portion of the chain path was located generally between the two major sprockets rather than substantially at the upper sprocket as in this embodiment. However, there is a substantial advantage in the reorientation at the upper sprocket, which advantage results in a smoother operation of the machine and accommodates the higher speed attainable in this embodiment. In particular it will be noted that because the grippers are swinging in an arc about the sprocket shaft 830 (see FIG. 28) they have a higher speed than the chain itself on the sprocket because of the larger radius thereof, which higher speed will cause the grippers to automatically swing forward when the right cam member lifts off the drum 260 at the region generally identified by the numeral 832. Consequently for a machine operating at a substantial speed the forward rotation of the grippers will be automatically achieved, the grippers being captured at the desired forward angular orientation by the capturing of the left cam member when the appropriate angular orientation is reached. Thus the main function of the cam plate 822 is simply to guide and encourage the forward motion, particularly at low operating speeds where inertial effects may not be dominant.

Figure 26:
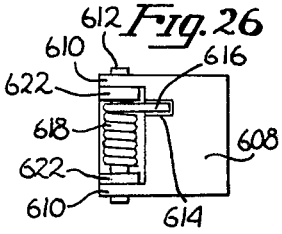
FIG. 26 is a view of the bottom of one of the cleat mounting members taken along line 26—26 of FIG. 25.
Figure 24:
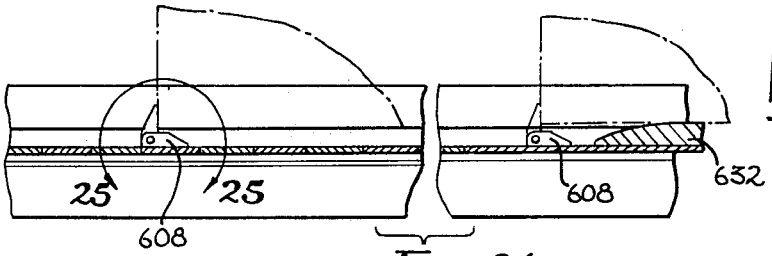
FIG. 24 is a cross section of the conveyor taken along lines 24—24 of FIG. 23.
Figure 33:
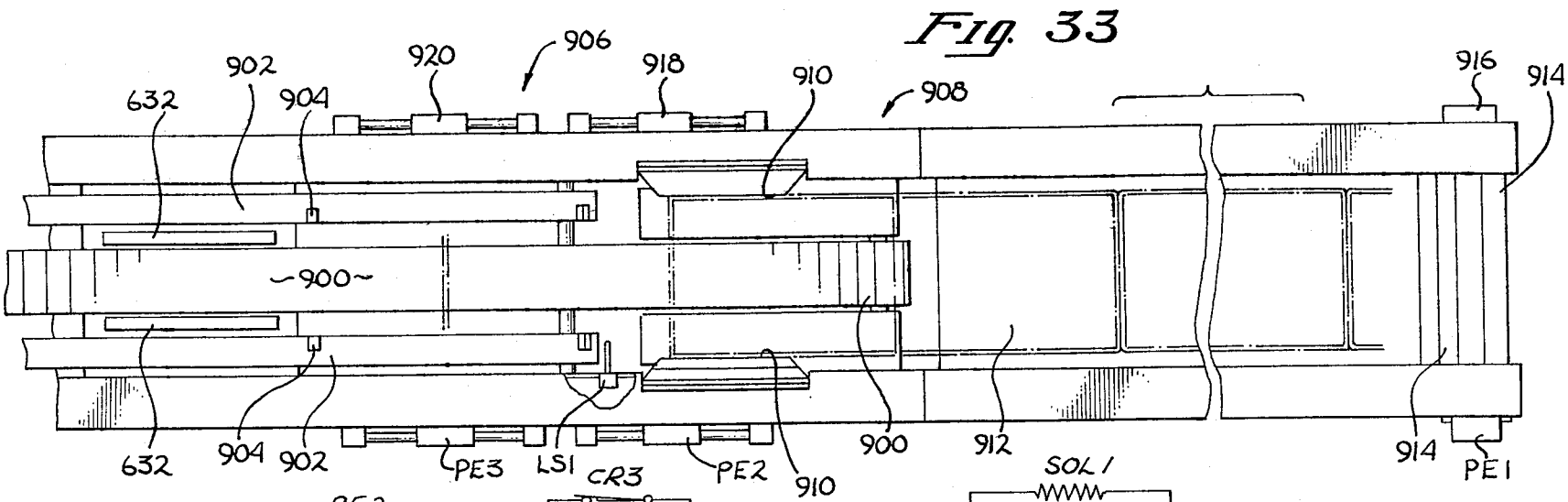

Now referring to FIG. 33, a top view of the case infeed portion of this embodiment of the uncaser may be seen. As before, there is a central conveyor 900 on which the cases are individually transported under the uncasing head (to the left of FIG. 33) with skid-like members 632 extending upward slightly above the top surface of conveyor 900 at each side thereof to lift the cases slightly off the conveyor so to not further be transported thereby. A pair of side conveyors 902 carrying cleats 904 of a design previously described with respect to FIGS. 25 and 26 are provided one at each side of the central conveyor 900 so that the cleats engage a case resting on the members 632 to slide the case therefrom and propel the case on conveyor 900 through the uncasing head in a synchronized manner. While the conveyors 902 extend forward only to regions generally indicated by the numeral 906, the central conveyor 900 extends forward to approximately the region indicated by the numeral 908. As before, intermediate the region 906 and 908 are a pair of case engaging members 910, each one being supported on a pair of air operated piston cylinder assemblies so as to move inward and outward in unison and with their faces parallel to controllably engage cases passing therebetween and to both stop and center the cases thereby. Still forward of the forward end of case conveyor 900 in this embodiment is a conveyor 912 having a high friction surface such as a rubber surface so as to more positively propel cases thereby. The clutch brake assembly receives power from the main conveyor drive to controllably drive the conveyor 912 or stop the conveyor in the shortest possible distance. Still forward of the conveyor 912 are a pair of rollers 914 for cooperating with a roller conveyor feed thereto.

In this embodiment a photo switch PE1 is provided at the case infeed to the system in addition to a case clamp photo switch PE2, a case clear photo switch PE3 and a cleat detector mechanical switch LS1. The case clamp switch PE2 as well as the switch PE3 are adjustable in longitudinal position, the switch PE2 preferably being adjusted so as to detect the leading edge of the case when the case engaging means are to clamp the case at that location. The photo switch PE3, on the other hand, is preferably adjusted so as to be located one case downstream from the operative position of the switch PE2. Of course switches PE1, PE2 and PE3 all extend above the frame and are operative on reflectors 916, 918 and 920 to detect a passage of therebetween. The cleat switch LS1, on the other hand, in this embodiment is a mechanical switch located below the transport surface of the case conveyor 900 so as to be operative only on the passage of a cleat thereby. Finally, in addition to the switches just described, there are two additional switches on the outlet side of the uncasing system, specifically a photo switch PE4 on the empty case outfeed conveyor from the uncasing system and a mechanical switch on the bottle delivery conveyor receiving bottles from the uncaser. The switch on the case outfeed has a time delay so as to not be operative on the passage of individual cases thereby, though in the event the photosensor remains dark for periods exceeding the normal periods for passage of a single case the switch becomes operative. The bottle delivery conveyor mechanical switch MS1, on the other hand, senses side pressure on the bottles being delivered thereto which occurs only when bottles are accumulating on that conveyor because of the slower operation of the equipment receiving the bottles. In particular, the uncaser normally reasonably well centers the bottles on the conveyor so that they miss the mechanical switch, though on backup of the bottles the resulting side pressure operates the switch. Both of these switches, it should be noted, are located sufficiently downstream on the two outlet conveyors so as to allow ample room remaining on these conveyors for receiving those cases and bottles which have progressed at least into the synchronizing system of the equipment.

Figure 34:
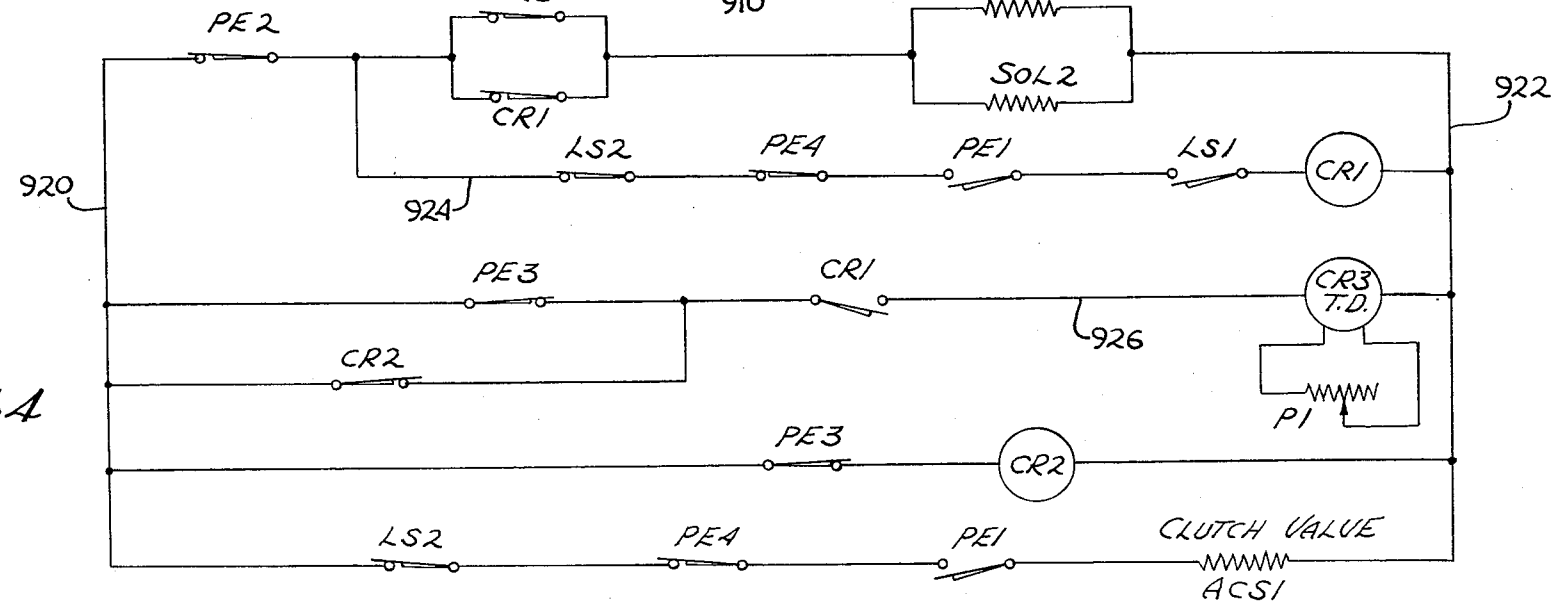
FIG. 34 is a circuit diagram for the embodiment of FIGS. 28 through 33.

Referring to FIG. 34, a switch logic diagram for this embodiment of the synchronizing system may be seen. The primary function of this circuit is to control the solenoid valves controlling the case clamps 910 so as to engage and release the cases in a synchronized manner. These case clamps are controlled by the solenoid valves SOL1 and SOL2, with the clamps being in the withdrawn position prior to energizing the solenoids. In addition to the switches hereinbefore identified, the circuit also utilizes three control relays, specifically control relays CR1, CR2 and CR3. Finally, control relay CR3 has a time delay coupled thereto, the time delay interval being manually controllable by variable resistance P1. Such time delays generally temporarily sustain a current through the control relay coil so as to delay the response of the control relay to the removal of excitation therefrom, the rate of decay of the current and thus the time delay period being controllable, as through potentiometer P1. These circuits of course are well known in the general field of industrial controls.

The photoelectric switches are commercially available switches having switch contacts identified as normally open and normally closed, the normally open position representing the light as opposed to dark state. This nomenclature with respect to normally open (NO) and normally closed (NC) is carried over in the diagram of FIG. 34. Also, while not shown, lines 920 and 922 are coupled to the main power through the main power switch so as to always be operative when the uncaser drive is operative.

When the machine is first turned ON and there are no cases in the system all the photoelectric switches will be light. Thus the case clamp photoelectric switch PE2 will be in the open position so that no excitation is provided to the control relay CR1 through line 924. Since the control relay CR1 is OFF, the control relay switch CR1S1 is closed and CR1S2 is open. Thus no power is applied to control relay CR1 through line 926 either. Also since the case infeed photoelectric switch PE1 is light no power is applied to the air clutch solenoid valve ACS1 so that the feed conveyor 912 is off. When the first case enters the system it will cause the first photoelectric switch PE1 to go dark, thereby applying power to the clutch solenoid valve ACS1 to advance that case onto the conveyor 912. If that case is the first of a steady stream of cases, the photoelectric switch PE1 will remain dark for so long as that stream of cases is available, though if it is an isolated case PE1 will go light after the case passes to stop the conveyor 912 until another case approaches immediately therebehind. When the first case reaches the case clamp photo switch PE2, that switch closes, energizing SOL1 and SOL2 to close the case clamp on the case. Thus it may be seen that the photoelectric switch PE1 provides a lock out for the clutch solenoid ACS1 so that conveyor 912 cannot operate except in a manner to always keep itself full of cases. Further it will be noted that the switches PE4 and LS2 are coupled in series with the clutch solenoid valve ACS1 as well as in series with the control relays CR1 and CR3 controlling, among other things, the control relay switch CR1S1 to control the case clamp solenoid valves. Consequently when the uncased bottles back up, or the empty cases back up, the conveyor 912 is disabled. Under this condition, if there is a case in the proper position in the case clamp 910 the case clamp photoelectric switch PE2 will close as shown in the figure, thereby providing power to the solenoid valves SOL1 and SOL2 to lock the case clamps 912 in the extended or clamped position.

Assuming no uncased bottle back up or empty case back up at the outlet of the uncaser system, the switches PE4 and LS2 will remain closed. Assuming also that an adequate supply of cases for uncasing is provided to the system, the case infeed photoelectric switch PE1 will remain closed by the back up of cases at the inlet to the conveyor system. Under this condition, assuming a random position on the cleats on the synchronizing conveyor, the cleat switch LS1 will be open and control relays CR1 and CR3 will be unactuated. Also control relay CR2 will be actuated as a result of the normally closed condition of the case clear photoelectric switch PE3. When the cleats come by the cleat switch, the cleat switch LS1 will temporarily close. This provides power to control relays CR1 and CR3, with control relay CR1 quickly actuating to open control relay switch CR1S1 and close control relay switch CR1S2. Closure of CR1S2 effectively latches the control relay by providing an alternate source of power thereto after the cleat switch LS1 returns to the open position on passage of the cleats. The case being clamped by the case clamp is not immediately released however, as the control relay switch CR3S1 will remain closed until the time delay relay CR3 is actuated, dependent upon the time delay set by potentiometer P1. When the control relay CR3 actuates, both switches CR1S1 and CR3S1 will be in the open position, thereby removing the excitation from the case clamp solenoid valves and allowing the case clamps to withdraw to release the case therein. The released case will proceed along the conveyor 900, actuating the case clear photoelectric switch PE3 when it is one case length downstream. This opens both poles of the case clear photoelectric switch PE3, removing power from the control relay CR2 which in turn releases power from control relay CR1 and CR3, thereby closing control relay switch CR1S1 to actuate the case clamp solenoid valves and clamp the next case, provided of course the case clamp photoelectric switch PE2 is closed indicating a case in position to be clamped. Removal of power from control relay CR1 also opens control relay switch CR1S2, thereby latching control relay CR1 and control relay CR3 in the open condition.

In the foregoing description it was stated that the position of the case clear photoelectric switch PE3 should be one case length downstream from the leading edge of the case being clamped by the case clamps 910 as determined by the position of the photoelectric switch PE2. Actually it is preferred to have photoelectric switch PE3 very slightly downstream from exactly one case length so that when photoelectric switch PE3 is actuated, the leading edge of the case immediately clamped thereby will be sufficiently forward to assure that the photoelectric switch PE2 remains dark, thereby assuring that the case clamp photoelectric switch PE2 will not momentarily go light to momentarily release the case clamps as the case previously released separates from the case being clamped.

Based on the foregoing description it is apparent that the synchronizing system is disengaged by backup at the outlet thereof, preferably sufficiently far downstream so that the uncasing head itself may continue to operate to clear all cases and bottles which had preceded into the synchronizing system, and is further disabled until an adequate supply of cases is provided at the case infeed to assure proper operation thereof. Thereafter the cases are automatically released in synchronization with the cleats on the synchronizing system in a controlled and fully adjustable manner, particularly through the manually controllable time delay relay which allows adjustment of the relative release points of the cases as machine operating speed is increased so as to provide the smoothest possible operation. In particular, as mentioned before, proper adjustment of the release point results in the release of the cases in such a manner that the cases don't even totally stop on the members 632, but merely slow down as they slide therealong until engaged by the respective pair of cleats 904, so that the impact between the cleats 904 and the case on the members 632 is minimal even at the very high operating speeds.

Thus, while certain preferred and alternate embodiments of the present invention have been disclosed and described herein, it will be understood by those skilled in the art that various changes in form and detail may be made therein without departing from the spirit and scope of the invention.

I claim:

1. An uncasing machine comprising:

a plurality of gripping means each having actuating members, each of said gripping means being a means for automatically gripping the neck of a bottle adjacent the top thereof upon the upward encouragement of said actuating member from a lower first position by contact with the top of a bottle, and for releasing the bottle by the forcing of said actuating member from a second upper position to said first position;

support means for supporting said gripping means, said support means being means for yieldably supporting each of said gripping means in predetermined dispositions in parts of the path of travel of a transport means, a transport means coupled to said support means, said transport means being a means defining a continuous said path of travel of each of said gripping means, said path of travel including a first leg having a substantial downwardly angle so that said gripping means may proceed downward to engage bottles at a first transport position, substantially immediately followed by a second leg having an upward angle substantially equal in magnitude to said downward angle and synchronizing means, including a conveyor means, for conveying cases filled with bottles past said first transport position at a uniform velocity and in synchronization with said transport means.

2. The uncasing machine of claim 1 further comprised of means for maintaining said gripping means in a vertical disposition while traveling along said first leg.

3. The uncasing machine of claim 2 wherein said transport means is a means further defining a substantially horizontal third leg of said path of travel following said second leg, said actuating member of each of said gripping means extending above its said support means, said transport means having engaging means for engaging the top of said actuating members in said third leg to force said actuating members downward to said first position.

4. The uncasing machine of claim 3 wherein said transport means comprises a pair of spaced apart continuous chain means, each of said chain means being driven through said predetermined path, said support means being means for extending between said chain means at a plurality of locations along said path of travel in accordance with the spacing of bottles in cases and the synchronization of cases by said synchronizing means.

5. The uncasing machine of claim 4 further comprised of slide means adjacent said chain means, and cam means coupled to said support means for engaging said slide means for determining the orientation of said support means in some regions of said path of travel.

6. The uncasing machine of claim 5 wherein said transport means further comprises a chain slide member coupled to said chain means and having a selectably locatable hole therein; and said support means comprises a cam member coupled to said chain slide member by a shaft extending through said cam member and said hole in said chain slide member and further comprises a cross member cooperating with said cam member to form a detent therebetween whereby said cam member is yieldably restrained against rotation with respect to said cross member.

7. The uncasing machine of claim 6 wherein said cam member is spring biased into cooperative detent engagement with said cross member.

8. The uncasing machine of claim 6 wherein said cam member cooperates with said transport means for determining the orientation of said support means.

9. The uncasing machine of claim 8 wherein there is one such cam member located at each end of said cross member only one of which cam members determines the orientation of said support means at any given time.

10. An uncasing machine comprising:

a plurality of gripping means each having actuating members, each of said gripping means being a means for automatically gripping the neck of a bottle adjacent the top thereof upon the upward encouragement of said actuating member from a lower first position by contact with the top of a bottle, and for releasing the bottle by the forcing of said actuating member from a second upper position to said first position;

support means for supporting said gripping means, said support means being means for yieldably supporting each of said gripping means in predetermined dispositions in parts of the path of travel of a transport means, a chain transport means located at each side of said coupled to said support means, said chain transport means being a means defining a continuous said path of travel of each of said gripping means, said path of travel including a first leg having a substantial downwardly angle so that said gripping means may proceed downward to engage bottles at a first transport position, substantially immediately followed by a second leg having an upward angle substantially equal in magnitude to said downward angle, the transition between said first leg and said second leg being defined by small sprockets under which said chain transport means passes, said chain transport means also defining a third substantially horizontally leg over a bottle conveyor, a fourth upward leg substantially parallel to said second leg, and a return leg coupling said fourth and said first leg;

means adjacent said third leg for engagement said actuating members to release bottles from said gripping means;

first conveyor means for carrying cases to be emptied past said first transport position, and a synchronizing means for synchronizing the disposition of cases on said first conveyor means with the disposition of said transport means.

11. The uncasing machine of claim 10 wherein said gripping means comprises an over center toggle mechanism actuated by said actuating member, said over center toggle mechanism being actuated by an upward movement of said actuating member and reset by the downward movement of said actuating member to said first position, said actuating member of each of said gripping means extending above its said support means, said chain transport means having engaging means for engaging the top of said actuating members in said third leg to force said actuating members downward to said first position.

12. The uncasing machine of claim 11 wherein said engaging means is disposed at a position between the start and the finish of said third leg.

13. The uncasing machine of claim 10 further comprised of slide means adjacent said chain transport means, and cam means coupled to said support means for engaging said slide means for determining the orientation of said support means during said first, third and return legs of said path of travel of said transport means.

14. The uncasing machine of claim 13 wherein said transport means comprises a pair of spaced apart continuous chain means, each of said chain means being driven through said predetermined continuous path, said support means being means for extending between said chain means at a plurality of locations along said path of travel in accordance with the spacing of bottles in cases and the synchronization of cases by said synchronizing means.

15. The uncasing machine of claim 14 further comprised of slide means adjacent said chain means, and cam means coupled to said support means for engaging said slide means for determining the orientation of said support means in some regions of said path of travel.

16. The uncasing machine of claim 15 wherein said cam means cooperates with said transport means to change the orientation of said support means with respect to said chain means in the region of the beginning of the return portion of said path of travel so as to take advantage of the natural centrifugal tendency of said grippers at said region.

17. An uncasing machine comprising:

a plurality of gripping means each having actuating members, each of said gripping means being a means for automatically gripping the neck of a bottle adjacent the top thereof upon upward encouragement of said actuating member from a lower first position by contact with the top of a bottle, and for releasing the bottle by the forcing of said actuating member from a second upper position to said first position;

support means for supporting said gripping means, said support means being means for yieldably supporting each of said gripping means in a predetermined orientation in parts of the path of travel of a transport means, a transport means coupled to said support means, said transport means being a means defining a predetermined continuous said path of travel of each of said gripping means, said path of travel including a first leg having a substantial downwardly angle so that said gripping means may proceed downward to engage bottles at a first transport position, substantially immediately followed by a second leg having an upward angle substantially equal in magnitude to said downward angle and a substantially horizontal third leg of said path of travel following said second leg, said actuating member of each of said gripping means extending above its said support means, said transport means having engaging means for engaging the top of said actuating members in said third leg to force said actuating members downward to said first position; and synchronizing means, including a conveyor means, for conveying cases filled with bottles past said first transport position at a uniform velocity and in synchronization with said transport means.

18. The uncasing machine of claim 17 wherein said transport means comprises a pair of spaced apart continuous chain means, each of said chain means being driven through said predetermined continous path, said support means being means for extending between said chain means at a plurality of locations along said path of travel in accordance with the spacing of bottles in cases and the synchronization of cases by said synchronizing means.

19. The uncasing machine of claim 18 further comprised of slide means adjacent said chain means, and cam means coupled to said support means for engaging said slide means for determining the orientation of said support means in some regions of said path of travel.

20. The uncasing machine of claim 18 wherein said transport means further comprises a chain slide member coupled to said chain means and having a selectably locatable hole therein; and said support means comprises a cam member coupled to said chain slide member by a shaft extending through said cam member and said hole in said chain slide member and further comprises a cross member cooperating with said cam member to form a detent therebetween whereby said cam member is yieldably restrained against rotation with respect to said cross member.

21. The uncasing machine of claim 20 wherein said cam member is spring biased into cooperative detent engagement with said cross member.

22. The uncasing machine of claim 20 wherein said cam member cooperates with said transport means for determining the orientation of said support means.

23. The uncasing machine of claim 22 wherein there is one such cam member located at each end of said cross member only one of which cam members determines the orientation of said support means at any given time.

* * * * *